US008904742B2

(12) United States Patent
Stephan et al.

(10) Patent No.: US 8,904,742 B2
(45) Date of Patent: Dec. 9, 2014

(54) AIR JET SPINNING MACHINE AND METHOD OF OPERATION THEREOF

(71) Applicant: Maschinenfabrik Rieter AG, Winterthur (CH)

(72) Inventors: Adalbert Stephan, Paulushofen (DE); Gerd Stahlecker, Fils (DE); Gernot Schäffler, Wäschenbeuren (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 13/921,592

(22) Filed: Jun. 19, 2013

(65) Prior Publication Data

US 2013/0333347 A1 Dec. 19, 2013

(51) Int. Cl.

| | |
|---|---|
| ***D01H 4/48*** | (2006.01) |
| ***D01H 4/50*** | (2006.01) |
| ***D01H 4/02*** | (2006.01) |
| ***D01H 15/00*** | (2006.01) |

(52) U.S. Cl.

CPC . *D01H 4/50* (2013.01); *D01H 4/48* (2013.01); *D01H 4/02* (2013.01); *D01H 15/002* (2013.01)

USPC ..... 57/263; 57/264

(58) Field of Classification Search

CPC ..... D01H 4/02; D01H 4/48; D01H 5/00

USPC ..... 57/22, 263, 264, 350

See application file for complete search history.

(56) References Cited

U.S. PATENT DOCUMENTS

| | | | | |
|---|---|---|---|---|
| 4,550,560 | A | 11/1985 | Tanaka et al. | |
| 5,232,373 | A | 8/1993 | Sawada | |
| 5,419,110 | A | 5/1995 | Mikami et al. | |
| 5,809,764 | A * | 9/1998 | Baba | 57/261 |
| 5,813,209 | A | 9/1998 | Hirao et al. | |
| 6,453,656 | B1 | 9/2002 | Nakayama | |
| 7,464,530 | B2 * | 12/2008 | Stahlecker et al. | 57/263 |
| 7,594,382 | B2 * | 9/2009 | Weide et al. | 57/263 |
| 2007/0125061 | A1 | 6/2007 | Schaeffler | |
| 2008/0066442 | A1 | 3/2008 | Stahlecker et al. | |
| 2009/0094958 | A1 * | 4/2009 | Weide et al. | 57/263 |
| 2013/0067879 | A1 * | 3/2013 | Stephan et al. | 57/78 |
| 2013/0067880 | A1 * | 3/2013 | Stephan et al. | 57/80 |

FOREIGN PATENT DOCUMENTS

| | | | |
|---|---|---|---|
| CH | 696 848 | | 12/2007 |
| DE | 33 36 294 | A1 | 4/1984 |
| DE | 103 35 651 | A1 | 3/2005 |
| DE | 103 47 060 | A1 | 5/2005 |

(Continued)

OTHER PUBLICATIONS

EPO Search Report, Dec. 2, 2013.

(Continued)

*Primary Examiner* — Shaun R Hurley

(74) *Attorney, Agent, or Firm* — Dority & Manning, P.A.

(57) ABSTRACT

The invention relates to a method of operation for an air jet spinning machine, which is characterized in that the spinning process is interrupted when a yarn fault is detected, and subsequent to the interruption of the spinning process, a piecing process is initiated which is at least partly carried out by the spinning station and in which a number of yarn process and handling devices directly assigned to the spinning station are applied. Furthermore, an air jet spinning machine is proposed which permits such a piecing method.

18 Claims, 24 Drawing Sheets

(56) References Cited

FOREIGN PATENT DOCUMENTS

| | | |
|---|---|---|
| JP | S59 204925 | 11/1984 |
| JP | H08 246272 | 9/1996 |
| WO | WO 94/00626 | 1/1994 |

OTHER PUBLICATIONS

German Patent Office Search Report, Apr. 12, 2013.

* cited by examiner

AIR JET SPINNING MACHINE AND METHOD OF OPERATION THEREOF

FIELD OF THE INVENTION

The present invention relates to a method of operation for an air jet spinning machine having at least one spinning station which comprises a vortex chamber. During a spinning process, a fibre strand is fed in a spinning direction to the vortex chamber, wherein the fibre strand is imparted a twist within the vortex chamber with the aid of an air stream so that a yarn having a twist is formed from the fibre strand. The yarn having a twist is withdrawn with the aid of a yarn withdrawal device, and wherein the yarn withdrawn from the vortex chamber with the aid of a yarn monitoring unit arranged downstream of the vortex chamber is monitored for yarn faults.

BACKGROUND

Generic air jet spinning machines are known from prior art. In the course of the spinning process, yarn faults occur repeatedly, that is, yarn sections form whose parameters (for instance yarn thickness, hairiness, yarn strength and so on) deviate from a given value. Yarn faults of this type are detected by a yarn sensor and must be removed in a clearer cut process which interrupts the spinning process. Yarn breaks (that is, the detaching of the yarn) are also a frequent occurrence, which also require the piecing of a yarn end to the fibre strand presented from the feed stock (so-called "piecing"). Bobbin changes are also necessary at regular intervals, in which a full bobbin, onto which the yarn is wound during the spinning process, is replaced by an empty bobbin.

In all cases, it is standard to release the respective wound-on yarn end from the bobbin surface with the aid of service robots patrolling the spinning stations, in order to be able to feed it in the opposite spinning direction to the spinning station again and to join it with the provided fibre strand. Furthermore, a certain section of the yarn must, as a rule, be removed before the piecing process takes place as the yarn end provided is mostly unsuitable for the spinning process.

Since service robots must first be moved to the respective spinning station and only one spinning station can be serviced by a robot, significant limitations in the spinning process occur due to the necessary piecing procedures. As a result, in particular the piecing processes, carried out in large numbers subsequent to the clearer cuts, contribute to a significant limitation in air jet spinning machine productivity.

SUMMARY OF THE INVENTION

It is an object of the present invention to propose a spinning machine, as well as a method of operation therefor, with the aid of which the piecing times can be reduced in comparison to prior art, especially subsequent to a clearer cut. Objects and advantages of the invention are set forth in part in the following description, or may be obvious from the description, or may be learned through practice of the invention.

According to the present invention, the method of operation is characterized firstly in that the spinning process is interrupted by the detection of a yarn fault in such a way that the yarn is detached from the fibre strand thus causing a yarn break. Furthermore, subsequent to the interruption of the spinning process, a piecing process is initiated at least partly by the spinning station, during which the following stages are carried out.

Firstly, the yarn end is subjected to a suction action with the aid of a first suction unit of the spinning station in the area between an exit opening of the vortex chamber and the withdrawal device. The first suction unit is, for instance, connected to a vacuum source via an addressable valve aided by means of a control and/or regulating unit, and can be activated and deactivated accordingly. Subsequent to the suction action on the yarn end, a separation of the end section comprising the yarn fault takes place in the area of the first suction unit, wherein in this case a yarn cutting unit of the spinning station, for instance a cutter, is applied. The yarn is previously unwound far enough from the bobbin, which bobbin takes up the yarn during the spinning process, that the yarn fault is located behind the yarn cutting unit and can reliably be separated from the rest of the yarn.

Subsequent to the completed separation process, the yarn end of the remaining yarn is guided through the vortex chamber in the opposite direction to the spinning direction, wherein for this purpose an air stream is generated which acts in the opposite direction to the spinning direction, the air stream sucking the yarn end via the exit opening into the vortex chamber. The air stream is generated with the aid of one or a number of air injection nozzles that run into the vortex chamber or into the withdrawal channel of the vortex chamber, which effect that the yarn end is again removed from the vortex chamber via its inlet opening. The respective air injection nozzles are preferably designed as bore holes, which penetrate the wall of the yarn forming element and pass into the withdrawal channel in the opposite direction to the withdrawal direction of the yarn.

In this area the yarn is gripped, for instance by service personnel or a service robot, and is prepared for a subsequent joining of the yarn end with an end section of the fibre strand (cutting to a defined length, thinning out of the yarn end etc.). When the yarn end is accordingly prepared, the withdrawal device (which can involve a winding device that drives the bobbin, or also a separate withdrawal roller pair upstream of the winding device) is put into operation again. Simultaneously, or respectively, directly subsequent thereto, the yarn end moving in the vortex chamber is superimposed on the end section of the fibre strand fed by the delivery device. The delivery device is put into operation again at this stage (namely, after an intermediary standstill), wherein the start-up of the delivery process can take place for instance after the yarn end has passed a yarn sensor that detects the yarn end.

Finally, the yarn end and the end section of the fibre strand with the yarn end superimposed thereon are drawn jointly into the vortex chamber by means of the start-up of the withdrawal device. The overlap area of yarn end and fibre strand, generated by superimposition, reaches the effective area of the air nozzles, which in the meantime are again subjected to compressed air (the air nozzles effecting the twist of the fibres of the fed fibre material). At this moment, the desired yarn having a twist is formed within the vortex chamber. The piecing process is thus completed—the actual spinning process can be continued with the feed of the fibre strand into the vortex chamber and the withdrawal of the yarn generated in the vortex chamber.

As a result, the method according to the invention provides a yarn defect removal and a subsequent piecing process of the remaining yarn end subsequent to the removal of the yarn fault at the respective spinning station, wherein if required the additional application of a service robot can be omitted completely. It is therefore advantageous when the spinning station is equipped with the necessary yarn process and handling devices, in order to be able to carry out the piecing process independently. For example it would be possible for the yarn end in the area of the inlet opening of the vortex chamber to be gripped by a second suction unit, preferably one assigned to the spinning station, and to be fed into a yarn end preparation device, preferably also one assigned to the spinning station (which yarn end preparation device in turn prepares the yarn end for a join-up with the end section of the fibre strand). The yarn end preparation device can, for instance, be located in the suction path of the second suction unit, so that a section of the yarn end automatically comes to lie in the area of the yarn end preparation device after the suction action. The second suction unit and/or yarn end preparation device can moreover either be assigned directly to the spinning station or be integrated in a service robot that travels along the spinning stations. In an extreme case, all spinning stations could be simultaneously re-started in this way. Furthermore, when a yarn fault is detected, its removal can begin directly, as the usual waiting time until the arrival of the service robot is eliminated, or at least it can be used for the removal of the yarn fault and the return feed of the yarn end through the vortex chamber.

It is also advantageous when the spinning process, in particular in the case of detection of a yarn fault by the yarn monitoring unit, is interrupted by means of reduction of the transport speed of one delivery device, which feeds the fibre strand, and the withdrawal device, wherein the reduction takes place in such a way that the yarn end, formed by the detaching of the yarn from the fibre strand subsequent to the completion of the reduction, is located between the outlet opening of the vortex chamber and the withdrawal device. In comparison to prior art, in which, subsequent to an interruption of the spinning process, the existing yarn end is inevitably wound onto the bobbin as the bobbin, due to its inertia, cannot be stopped abruptly, winding on can be prevented effectively by means of the method of operation of the present invention.

Air jet spinning machines are characterized in general in that certain basic parameters regarding the delivery speeds of the delivery device and the withdrawal device must be observed for the required yarn production. For instance, for the production of a high-quality yarn, the delivery device and the withdrawal device must exceed certain limiting values in order to enable the desired twist of the fibre material in the interior of the vortex chamber. If the above mentioned delivery speeds are gradually throttled, that is, preferably within a few seconds, the point is then reached at which no yarn production can take place, as either too little fibre material is transported in the vortex chamber or the yarn is withdrawn too quickly from the vortex chamber in relation to delivery of the fibre material. At this point in time, a yarn end is formed, which moves in the direction of the winding device in accordance with the remaining delivery speed of the withdrawal device.

It is advantageously provided that the delivery speeds within the scope of the interruption of the spinning process are reduced to zero in such a way that, subsequent to the standstill of the individual delivery devices, the yarn end is located between the outlet of the vortex chamber and the withdrawal device. It is therefore required that the yarn formation within the vortex chamber is interrupted by a gradual, and not an abrupt, throttling of the individual delivery speeds. The respective yarn end forms therefore by means of the corresponding adjustment of the individual delivery speeds. The yarn production is thus interrupted so that the yarn detaches from the following fibre material. As the delivery speeds at this point in time are considerably lower than during the actual yarn production process, the winding device can also be slowed selectively, so that a defined end position is reached, in which the end of the yarn is located at the described position, and therefore not on the surface of a respective bobbin of the winding device. In order to ensure an even winding-on of the produced yarn onto the bobbin even at reduced delivery speeds, it would lend itself to also reduce the speed of a possibly existing device for traversing the yarn (or to stop it centered). The end of the yarn can now be gripped at the above mentioned position by the first suction unit, in order to then carry out the above described piecing steps.

It is particularly advantageous when, subsequent to the suction of the yarn by means of the first suction unit, the yarn section extending in the area between the first suction unit and the withdrawal device is gripped by a yarn manipulator and moved partly in the direction of the outlet opening before the end section of the yarn containing the yarn fault is cut off so that a yarn loop is formed. However, it is also possible to dispense with the yarn manipulator and to solely suction the yarn end via the outlet opening by means of a prevailing low pressure in the vortex chamber. However, a yarn manipulator has proven to assist the re-feed, which for example can be designed as a swivel-mounted lever. Subsequent to the successful suction of the yarn end by means of the first suction unit, the lever is swiveled in such a way that it comes into contact with the yarn end (or respectively the section of the yarn end that is located between the withdrawal device and the suction opening of the first suction unit). By means of further swivel action, the so-called yarn loop is then formed, so that the yarn end takes up a course that extends from the withdrawal device via the area of the outlet opening of the vortex chamber. If the yarn section containing the yarn fault is removed by the yarn cutting unit, the remaining yarn end can be reliably sucked into the vortex chamber, as it is located already directly in the area of the outlet opening. Alternatively or in addition to the mechanical yarn manipulator, it is of course clear that a yarn manipulator can be applied that moves the yarn end with the aid of an air stream out of the first suction unit. An air stream can therein be applied that acts only outside of the first suction unit and draws the yarn end out of the suction unit. Also possible is an air stream that is generated within the first suction unit and presses the yarn end out of the first suction unit subsequent to the removal of the yarn fault. It is advantageous when the generated air stream is effective in the direction of the outlet opening of the vortex chamber, independent of its starting point, in order to move the yarn end in the direction of this opening during the piecing process.

It can be particularly advantageous when the yarn end of the remaining yarn, located in the area of the first suction unit subsequent to the separation of the yarn section containing the yarn fault, is blown into the area of the outlet opening of the vortex chamber with the aid of an air stream before the reverse feed through the vortex chamber. The air stream can, for instance, be generated by a blowing device, which is designed as a component part of the first suction unit, or as a separate component arranged in the area of the outlet opening of the vortex chamber. In any case, the air stream serves the selective movement of the yarn end in the direction of the outlet opening, in whose area the yarn end is gripped by the suction air stream generated by the air injection nozzle(s) and is sucked into the withdrawal channel of the yarn forming element and from there is blown into the area of the inlet opening of the vortex chamber.

It is extremely advantageous when a withdrawal channel, which extends inside the vortex chamber, and which the yarn passes, is subjected to an airstream directed in the direction of the entry opening before and/or during the reverse feed of the yarn end through the vortex chamber. By these means, the yarn reverse feed is actively supported during the piecing process, thus ensuring that the yarn end reaches the area upstream of the inlet opening. The air stream can, for instance, be generated in that, in the vortex chamber, a low pressure is generated prior to the guiding of the yarn end into the outlet opening. As soon as the yarn end is sucked into the withdrawal channel, compressed air can be either additionally or alternatively generated in the withdrawal channel, which pushes the yarn end effectively in the direction of the inlet opening of the vortex chamber. The generation of such an air stream can for instance be realized with the aid of one or a number of injection nozzles, which run into the withdrawal channel against the spinning direction.

Furthermore, it is advantageous when a yarn forming element extending inside the vortex chamber and leading into the outlet opening is moved prior to the cutting of the end section of the yarn containing the yarn fault, in order to reduce the distance between the withdrawal device and the outlet opening of the vortex chamber. As a result, a lower pressure within the vortex chamber is sufficient for sucking in the yarn subsequent to the cutting out of the yarn fault. The yarn forming element is preferably mounted axially movable for this purpose.

It is also advantageous when the suction nozzle of the second suction device is moved from a standby position to a first piecing position prior to the gripping of the yarn end, in which a suction opening of the suction nozzle is located in the area of the inlet opening of the vortex chamber. The suction nozzle can take up a location in the piecing position in which the suction opening of the suction nozzle comes into contact in an air-sealed way with the area surrounding the inlet opening of the spinning nozzle (e.g. the unit surrounding the vortex chamber). If the suction nozzle is then subjected to a low pressure, an air stream directed against the spinning direction arises within the vortex chamber and thus also inside the withdrawal channel, which air stream effects, or respectively, assists the feeding of the yarn end into the outlet opening and the reverse feed of same to the area of the suction nozzle. Preferably, it is provided that the suction nozzle can be swiveled out of its spinning position (in which there is no contact between the suction nozzle and the spinning nozzle) into the first piecing position with the aid of a drive device.

It also brings benefits when the suction nozzle of the second suction device, prior to the superimposition of the yarn end (still located outside the vortex chamber) on the end section of the fibre strand, is moved from the first piecing position into a second piecing position, in which the suction opening of the suction nozzle is located between a front roller pair of a delivery device that delivers the fibre strand, and a delivery section of the delivery device upstream of the front roller pair in the spinning direction. In the case of the upstream delivery section, an apron roller pair can, for instance, be involved, that is part of a delivery device designed as a drafting unit. By means of swiveling the suction nozzle, with the aid of which the yarn end is at this stage affixed, it is ensured that the yarn end is guided by the withdrawal roller pair when entering the vortex chamber. The superimposition of the yarn end on the end section of the fibre strand takes place therefore in the area of the front roller pair, so that it is ensured that the desired contact between the yarn and the fibre strand occurs prior to both jointly entering into the vortex chamber for further yarn production.

It is advantageous when at least one roller of a front roller pair of a delivery device located upstream of the vortex chamber in the spinning direction, is moved from a spinning position into a piecing position, prior to the movement of the suction nozzle from the standby position into the first piecing position, in which both rollers of the front roller pair are at a distance to one another. By these means, a free space between the two rollers of the front roller pair is created, which permits the swiveling of the suction nozzle into its first piecing position. The corresponding roller (with the aid of a drive device) can therein be designed to swivel around an axis of rotation.

It is particularly advantageous when the roller of the front roller pair located in the piecing position is moved to the spinning position, in which both rollers comes into contact with one another, subsequent to the suction nozzle being moved into the second piecing position and prior to the superimposition of the yarn end (still located outside of the vortex chamber and fixed by the suction nozzle) on the end section of the fibre strand. By these means, it is ensured that the above described guidance of the superimposition area between yarn end and fibre strand can take place during the entry into the vortex chamber. The movement of the individual moving parts of the spinning position can furthermore take place subsequent to detection of a yarn fault in a time-controlled manner. It is also possible that the spinning station comprises corresponding sensors, which monitor the presence of yarn ends at defined reference points so that the respective procedural stage can be started up or completed independently of the respective sensor signals.

It is also advantageous when the yarn that is withdrawn by the withdrawal device is wound onto a bobbin during the spinning process, and that in the case of a yarn break (that is the unintentional detaching of the yarn during winding on), the yarn end of the yarn already on the bobbin is gripped manually by a handling device of the respective spinning station or by a service robot on the bobbin surface, and is moved to the area of the first suction unit, and that subsequently the piecing processing according to the above description is carried out. In other words, the process according to the present invention provides a further possible development in that the yarn is not only pieced by the spinning station subsequent to the detection of a yarn fault. Rathermore, it is also possible that, subsequent to an end break, the piecing process is carried out by elements of the respective spinning station. As, however, a yarn break occurs relatively seldom in comparison to a clear cut, it is also possible that a service robot comes into operation for the subsequent spinning process, which at least takes up the yarn end from the bobbin (for instance, suctioned from the surface when the bobbin is rotated) and guides it to the first suction unit.

There are also advantages to be had when the fibre strand is taken from a sliver can with the aid of a delivery device upstream of the vortex chamber, that the filling level during the spinning process is monitored with the aid of a sensor and when the filling level falls below the given amount, the spinning process is interrupted in such a way that the yarn becomes detached from the fibre strand and a yarn end forms, wherein the sliver can is able to be replaced with a full one. Herein, an end section of the fibre strand of the full sliver can is preferably joined (manually or by means of corresponding handling devices) to an end section of fibre strand still located in the delivery device Subsequently, or respectively, simultaneously, the yarn end is suctioned by the first suction unit and the piecing process according to the present invention is begun, autonomously executed by the spinning station. In this case, the application of a service robot for the starting up of the spinning station can therefore also be dispensed with.

An ensuing further development is also advantageous in which the yarn is wound onto a bobbin arranged downstream of the withdrawal device during the spinning process. It is herein provided that the filling level of the bobbin is monitored with the aid of a sensor, and in the case of an excess of the given filling amount, the spinning process is interrupted in such a way that the yarn detaches from the fibre strand and a yarn end is formed and located subsequent to the interruption of the spinning process in the area of the first suction unit. The yarn end takes up a defined position at this stage, in which it can be suctioned by the first suction unit of the spinning station. Subsequently, the piecing process of the present invention takes place, in which the yarn end, as described, is superimposed on the fibre strand and they are jointly guided into the vortex chamber. In the next step, the yarn, having exited out of the vortex chamber subsequent to the piecing process, is cut by a service robot or by a yarning cutting unit assigned to the spinning station and the yarn produced by the spinning station subsequent to the cutting is stored intermediately. Intermediary storage can take place by means of sucking in the yarn produced in the meantime into a yarn storer of the service robot or also in the yarn storer assigned to the respective spinning station. During intermediate storage, the full bobbin is replaced by an empty one, onto which the stored yarn is wound (preferably by the robot). Subsequent to the completed bobbin change, the spinning process can be continued as usual and the yarn is again monitored for yarn faults.

As indicated, it can be advantageous when: the cutting of the yarn exiting from the vortex chamber subsequent to the piecing process; the intermediate storage of the yarn produced by the spinning station subsequent to the cutting of the yarn; the replacement of the full bobbin by the empty bobbin and/or; the winding on of the intermediately stored yarn onto the empty bobbin, is carried out by a service robot. Alternatively, processing and handling devices assigned to the spinning station could also be provided, which devices independently take over one or more of the above mentioned steps.

It can also be advantageous when the process according to the present invention for operating an air jet spinning machine, in which the yarn is wound onto a bobbin arranged downstream of the withdrawal device during the spinning process, and in which the filling level of the bobbin is monitored with the aid of a sensor, incorporates the following procedural steps: when an excess of the given value of the filling level is detected, the spinning process is first interrupted so that the yarn end is detached from the fibre strand. Subsequently, the spinning station is provided with a piecing yarn by a service robot patrolling along the spinning stations, which piecing yarn is suctioned by the first suction unit. Subsequent to the relevant fixing of the yarn end in the first suction unit, a piecing process according to the present invention takes place, after the completion of which a yarn having a twist is again withdrawn from the vortex chamber. The yarn exiting out of the vortex chamber is cut, wherein the yarn end on the bobbin side is wound onto the full bobbin and the yarn exiting out of the vortex chamber is stored intermediately with the aid of a yarn storer. The end section of the stored yarn is then wound onto the empty bobbin after a bobbin change, wherein the yarn storer is also emptied again. Subject to completion of this process, the actual spinning process can be continued.

In this connection, it is also advantageous when the following are carried out by a service robot: the piecing yarn is provided to the first suction unit; the cutting of the yarn exiting out of the vortex chamber subsequent to the piecing process; the intermediate storage of the yarn produced by the spinning station subsequent to the cutting of the yarn; the exchange of the full bobbin for an empty bobbin and/or; the winding on of the intermediately stored yarn onto the empty bobbin. Alternatively, it is also possible in this case to carry out one or more steps with the aid of process and handling devices assigned to the spinning stations.

Furthermore, an air jet spinning machine is proposed, with the aid of which one or more of the above mentioned procedural steps can be realized. Preferably, the air jet spinning machine is designed to carry out a clearer cut autonomously, that is, the removal of a yarn fault and the subsequent piecing process (attaching of the yarn end to an end section of the fibre strand provided for the spinning station) without the additional application of a service robot. The spinning station includes a first suction unit, with the aid of which the yarn can be suctioned between the outlet opening of the vortex chamber and the withdrawal device. The first suction unit herein serves in particular the suctioning of the yarn end, which forms subsequent to the detection of a yarn fault due to the interruption of the spinning process. The first suction unit is operatively connected to a low pressure source, wherein the activation of the low pressure source, or respectively, the connection of the first suction unit to the low pressure source, takes place subsequent to the detection of the yarn fault, so that during the actual spinning process the yarn is not caused any impairment by the first suction unit. Furthermore, the spinning station comprises a yarn cutting unit (for instance a cutter), with the aid of which the yarn, located between the outlet opening of the vortex chamber and the withdrawal device, is able to be cut subsequent to the suction action by the first suction unit. Therefore, the cutting of the yarn end containing the yarn fault is permitted with the aid of the yarn cutting unit. In order to enable the reverse feed of the yarn end of the remaining yarn in the opposite direction to the spinning direction through the vortex chamber, without a service robot or the intervention of service personnel being necessary, it is provided that the spinning station possesses at least one air injection nozzle of its own. The air injection nozzle is, in addition, aligned in such a way that air in the direction of the inlet opening is introduced into the vortex chamber, or respectively, a withdrawal channel of a yarn forming element projecting into the vortex chamber, through which withdrawal channel the yarn passes. The air injection nozzle (of which more than one can be present) is preferably formed by a bore hole, which extends from an air channel through at least a part of a wall of the yarn forming element. The bore hole runs into the withdrawal channel of the yarn forming element in the opposite direction to the withdrawal direction of the yarn, so that an air stream is generated with the aid of the air injection nozzle(s), which extend(s) from the withdrawal channel via the vortex chamber to the area of the inlet opening of the vortex chamber. If the air nozzle is subjected to air during the reverse feed of the yarn end, an air stream occurs that seizes the yarn end in the area of the outlet opening of the vortex chamber, sucks it into the withdrawal channel, and blows it eventually into the area of the inlet opening of the vortex chamber. The yarn end can then be prepared (for instance with the aid of a service robot or manually) for the subsequent piecing process.

Following the cutting of the above mentioned yarn section, and in order to prepare the yarn end for the subsequent piecing process, the air jet spinning machine however can comprise a yarn end preparation device or, preferably one assigned to the respective spinning station, which preparation device is assignable to the spinning station for the purposes of preparing a yarn end for a subsequent attachment of the yarn end with an end section of the fibre strand. The yarn end preparation device can therein take over the yarn preparation at one, or also a number of, spinning stations.

In the event it can also be provided that the air jet spinning machine comprises at least a second suction unit, which is assignable to the spinning station, and with the aid of which the yarn end is suctioned in the area of the outlet opening of the vortex chamber prior to the above mentioned yarn end preparation, and which can be brought into the effective area of the yarn end preparation device. The yarn end preparation device and/or the second suction unit, depending on the embodiment of the air jet spinning machine, can, for instance be positioned in a service robot that patrols along the air jet spinning machine. It is also possible to equip the spinning stations themselves with a yarn end preparation device and/or a second suction unit, wherein a yarn end preparation device and/or a second suction unit per spinning station can be present. Alternatively, however, it is also possible to arrange a yarn end preparation device and/or a second suction unit to a number of spinning stations, for example, two spinning stations, in order to be able to carry out a piecing process at the respective spinning station.

There are also advantages to be had when a yarn manipulator is assigned to the spinning station, with the aid of which a yarn section extending between the first suction unit and the withdrawal device is movable in the direction of the outlet opening of the vortex chamber. By these means, it is possible to move the yarn end remaining after the removal of the yarn fault as near as possible to the outlet opening of the vortex chamber. This facilitates in turn the sucking in of the yarn end into the vortex chamber, which is necessary in order to be able to move the yarn during the above described piecing process in the opposite direction to the spinning direction through the withdrawal channel of a yarn forming element arranged inside the vortex chamber (in the event the yarn end must—as seen in spinning direction—be brought into contact with the fibre strand fed to the spinning station prior to reaching the spinning nozzle.)

It is particularly advantageous when the yarn manipulator includes a swivel lever, which is rotatable around a swivel axis and comprises a contact section which can be brought into contact with the yarn section. In the inoperative position (that is during the spinning process), the swivel lever preferably takes up a position in which it does not come into contact with the yarn. When a yarn fault is detected, the formed yarn end as a result of the interruption of the spinning process is at first gripped by the first suction unit and fixed accordingly. Subsequently, the lever can be swiveled into a piecing position, in which the lever comes into contact with the yarn (that is with the section of same between the withdrawal device and the first suction unit) and the respective yarn section is moved into the area of the outlet opening of the spinning nozzle. If subsequent to the cutting of the yarn fault, a low pressure is now generated in the vortex chamber, the yarn end can be suctioned and inserted into the vortex chamber. As mentioned above, it is also possible alternatively or in addition thereto, to bring a yarn manipulator into operation, which moves the yarn end, with the aid of an air stream, out of the first suction unit. The yarn manipulator can be positioned in this case in such a way that it can generate an air stream, which is effective solely outside of the first suction unit and pulls the yarn end out of the first suction unit. It is also possible that the yarn manipulator, or respectively a blower unit of the yarn manipulator, leads into the first suction unit and can generate an air stream there, which presses the yarn end out of the suction unit. It is advantageous when the generated air stream is effective, independent of its starting point, in the direction of the outlet opening of the vortex chamber, in order to move the yarn end during the piecing process in the direction of this opening.

Furthermore, it can be advantageous when a blower unit is assigned to the spinning point, with the aid of which blower unit an air stream can be generated, which is directed outside of the vortex chamber in the direction of the outlet opening of the vortex chamber. The blower unit can for instance be designed as a component part of the first suction device or positioned as a separate part in the area of the outlet opening of the vortex chamber. It is the task of the blower unit to blow the yarn, remaining after the removal of the yarn fault, in the direction of the outlet opening of the vortex chamber subsequent to its release from the first suction unit, or respectively, from the withdrawal device, where the yarn is suctioned into the withdrawal channel by means of the air stream generated by the air injection nozzle(s) and moved by means of the air stream in the withdrawal channel to the area of the inlet opening of the vortex chamber.

It is also advantageous when the first suction unit, the yarn cutting unit and/or the yarn manipulator are fixed to a housing encasing the vortex chamber. The above mentioned components form in this case a structural unit, so that additional holding or bearing devices can be dispensed with. The yarn cutting unit can, in addition, be positioned upstream of the suction opening of the first suction unit, or it can also be positioned in the suction channel itself. The fixing to the above mentioned housing need not take place directly. It is self-evident that it is also possible to connect the first suction unit, the yarn cutting unit and/or the yarn manipulator at first together, or with a bearing, which in turn is connected to a housing (or alternatively to a frame structure of the spinning machine).

It is advantageous when the spinning station comprises a yarn forming element having a withdrawal channel for the yarn, the yarn forming element projecting into the vortex chamber, wherein the withdrawal channel leads into the outlet opening, and wherein the yarn forming element is movable relative to the inlet opening. By means of the preferable axial movement of the yarn forming element, the sucking in of the existing yarn end, resulting from the removal of the yarn fault, into the withdrawal channel of the yarn forming element is facilitated, as the distance between the withdrawal arrangement and the spinning nozzle when the yarn forming element is extended is reduced in comparison to the situation during the actual yarn production. The suction action on the yarn is thus reinforced at the vortex chamber with the application of a low pressure, and the insertion of the yarn end into the yarn forming element is facilitated.

It is also advantageous when the second suction unit comprises a movably mounted suction nozzle, which is movable between a standby position and a first piecing position, in which a suction opening of the suction nozzle is located in the area of the inlet opening of the vortex chamber. The suction nozzle can be set directly in the area of the spinning nozzle surrounding the inlet opening in order to suction the yarn end exiting out of the inlet opening during the piecing process (piecing position). During the spinning process, however, it is necessary that the fibre material of the fibre strand can be inserted into the spinning nozzle without hindrance. At this stage, the suction nozzle is swiveled into its spinning position and is located in an area in which it cannot collide with the fibre strand.

It is particularly advantageous when the suction nozzle is movable between the first piecing opening and a second piecing opening, in which the suction opening of the suction nozzle is located between a front roller pair of the delivery device and a delivery section of the delivery device, which is upstream of the front roller pair. The yarn suctioned by the second suction unit also runs in this position between the two rollers of the front roller pair. If the yarn end is now fed again in the spinning direction into the vortex chamber subsequent to the completed yarn end preparation and in doing so, the end section of the fibre strand is superimposed on the yarn end, the yarn end is then guided, and thus also the fibre strand, with the aid of both withdrawal rollers that are positioned adjacently to one another. This ensures that the yarn end and the fiber strand remain in contact with each other during the feeding process and that the yarn end and fiber strand can be subjected to the air stream inside the vortex chamber.

It is also advantageous when the suction nozzle is rotatable around a rotational axis. The rotation can, for instance, take place with the aid of a drive device, so that the suction nozzle can be swiveled optionally into the first piecing position, the second piecing position, or the spinning position. The rotational axis is located, for instance, between the suction opening of suction nozzle and the yarn end preparation device, so that the suction nozzle can be swiveled without having to move the yarn end preparation device (the device can in this case be connected to a bearing structure of the spinning machine). The suction nozzle can also be rotatably mounted in a bearing, wherein the bearing in turn can be connected to an air channel, that is connected to a low pressure source and in the course of which the yarn end preparation device can be arranged.

There are also advantages to be had when a joint yarn end preparation device is arranged to each of two spinning stations, wherein the vortex chambers of both spinning stations each having a separate suction nozzle that can be brought into operative connection with the yarn end preparation device. The yarn end preparation device can in this case be fixed in a non-moving manner in the area of the spinning station it is assigned to and be connected via corresponding tube connections to the suction nozzle. In connection herewith, it is possible for instance that both suction nozzles are both mounted in a rotatable bearing and each pass into a rigidly mounted suction channel, which in turn merges into a yarn preparation device, or respectively, contains it. The rotatable bearing can, in this case, form the crossover between the movable suction nozzles and the rigid little tube connection pieces. It is also conceivable to equip the suction nozzles, or respectively, the rigid tube connection or connections with one or a number of valves, so that optionally, one or both suction nozzles can be brought into connection with a low pressure source in order to assist the piecing process at the respective spinning station.

It is particularly advantageous when the delivery device includes a front roller pair upstream of the inlet opening, wherein at least one roller of the front roller pair is movable from a spinning position into a piecing position in which both rollers are at a distance from one another. The distance between the two rollers in the piecing position should be measured in such a way that the suction nozzle of the second suction unit assigned to the spinning station can be moved into its spinning position up to the area of the inlet opening of the spinning nozzle without colliding with the front roller pair.

It is furthermore advantageous when the vortex chamber is a component part of the spinning nozzle, and which vortex chamber can be moved, preferably by means of a swivel movement, from a spinning position into a piecing position. A movement of this kind is in certain circumstances advantageous in order to permit the arrangement of the suction nozzle of the second suction unit on the spinning nozzle. The spinning nozzle is brought in this case from a spinning position into a piecing position prior to the suction nozzle being swiveled into its first piecing position. This swivel action means that only one of the two withdrawal rollers of the withdrawal roller pair needs to be swiveled during the swivel action of the suction nozzle. If the spinning nozzle and also one of the withdrawal rollers remain in their spinning positions while the suction nozzle is moved into its first piecing position, there could, depending on the spinning station geometry, be a possible collision between the withdrawal roller and the suction nozzle.

It is also advantageous when a yarn storer is arranged downstream of the withdrawal device. The yarn storer can for instance be designed as a suction tube having a connection to a vacuum source. The yarn storer serves in particular as an intermediate storage place for a defined amount of yarn while the spinning process is interrupted, and/or during the piecing process, so that varying acceleration, or respectively, braking speeds of the parts that come into contact with yarn do not directly result in a yarn break.

It is advantageous when the air spinning machine comprises a control and/or regulating device, that is designed to drive the air jet spinning machine according to one or more of the previous procedural steps. With regard to individual variations and their advantages, reference is made to the above mentioned as well as the following description.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
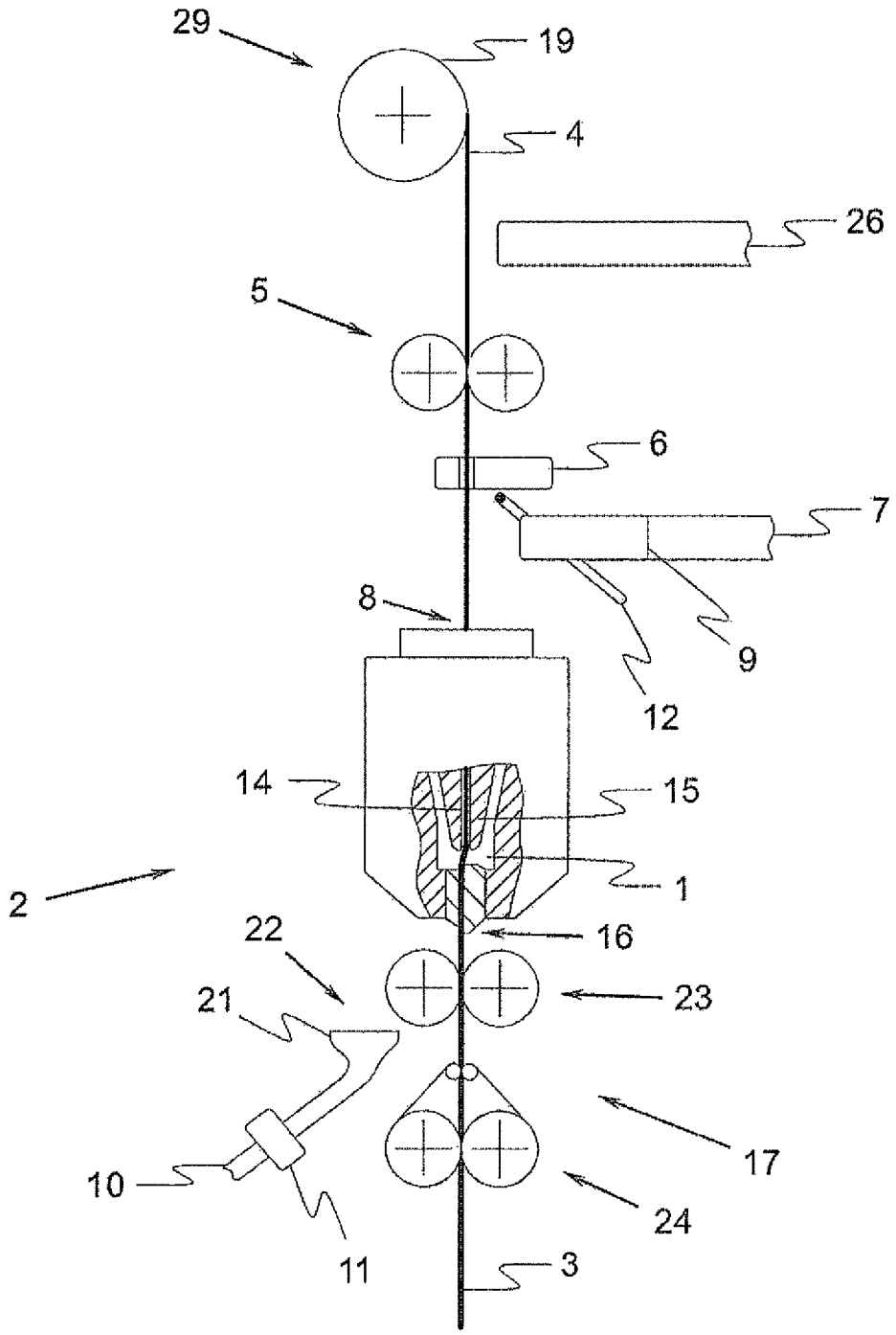
FIGS. 1 to 11 are schematic depictions of the piecing process according to the present invention at the point of detection of a yarn fault.

Reference is now made to particular embodiments of the invention, one or more examples of which are illustrated in the drawings. Each embodiment is provided by way of explanation of the invention, and not as a limitation of the invention. For example, features illustrated as described as part of one embodiment may be used with another embodiment to yield still a further embodiment. It is intended that the present invention include these and other modifications and variations.

FIG. 1 shows a schematic side view of a spinning station 2 of an air jet spinning machine during the spinning process, wherein the air jet spinning machine includes as a rule a number of spinning stations 2 preferentially identically assembled and arranged one behind the other perpendicular to the drawing plane.

The air jet machine comprises in the shown example in FIG. 1 a delivery device 17 designed as drafting unit, said delivery device 17 being supplied with a fibre strand 3, for instance in the form of a double sliver provided in the sliver can (not shown). The shown spinning station 2 comprises further a spinning nozzle 28 (labeled in FIG. 5) at a distance to the delivery device 17 having an inlet opening 16 for the fibre strand 3 and an internal vortex chamber 1.

The fibre strand 3, or respectively, at least a part of the fibres of the fibre strand 3, are provided for the production of the required yarn 4 in the known way with a twist inside the vortex chamber 1. The twist is herein formed by means of a selective air stream in the area of the tip of a yarn forming element 15, wherein the air stream is generated preferentially by means of air nozzles (not shown) which run tangentially into the vortex chamber 1.

The spinning station 2 shown includes further a withdrawal device 5 formed for instance by a withdrawal roller pair, as well as a winding arrangement 29 arranged downstream of the withdrawal roller pair and comprising an interchangeable bobbin 19. The winding device 29 serves to wind on the yarn 4 exiting out of the spinning nozzle 28, the yarn 4 exiting the vortex chamber 1 via a withdrawal channel 14 extending inside the yarn forming element 15, the withdrawal channel 14 in turn running into a corresponding outlet opening 8.

Furthermore, the air jet spinning machine comprises a yarn monitoring unit 6, which monitors the defined parameters of the yarn 4 (e.g. yarn thickness, yarn strength or other representative parameters for the quality of the yarn 4). The yarn monitoring unit 6 preferably functions as a non-contact device.

The air jet spinning machine of the present invention need not necessarily comprise a drafting unit, as is shown in FIG. 1. Also not absolutely required is that the withdrawal device 5 is formed by a separate roller pair. Rathermore, it is feasible that the winding device 29 could simultaneously carry out the withdrawal of the yarn 4 out of the vortex chamber 1, and the winding on of the yarn onto the bobbin 19.

Figure 2:
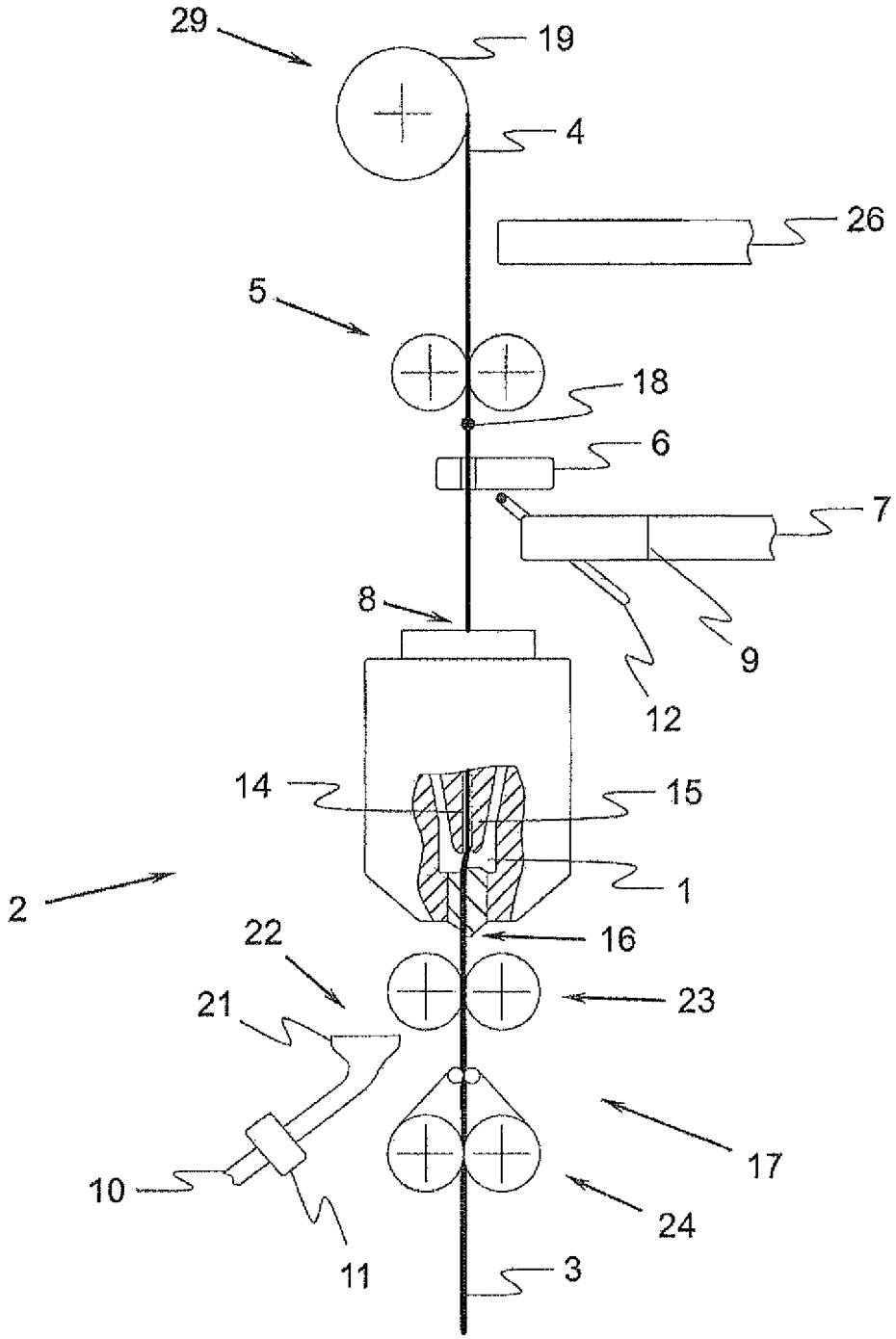
Figure 3:
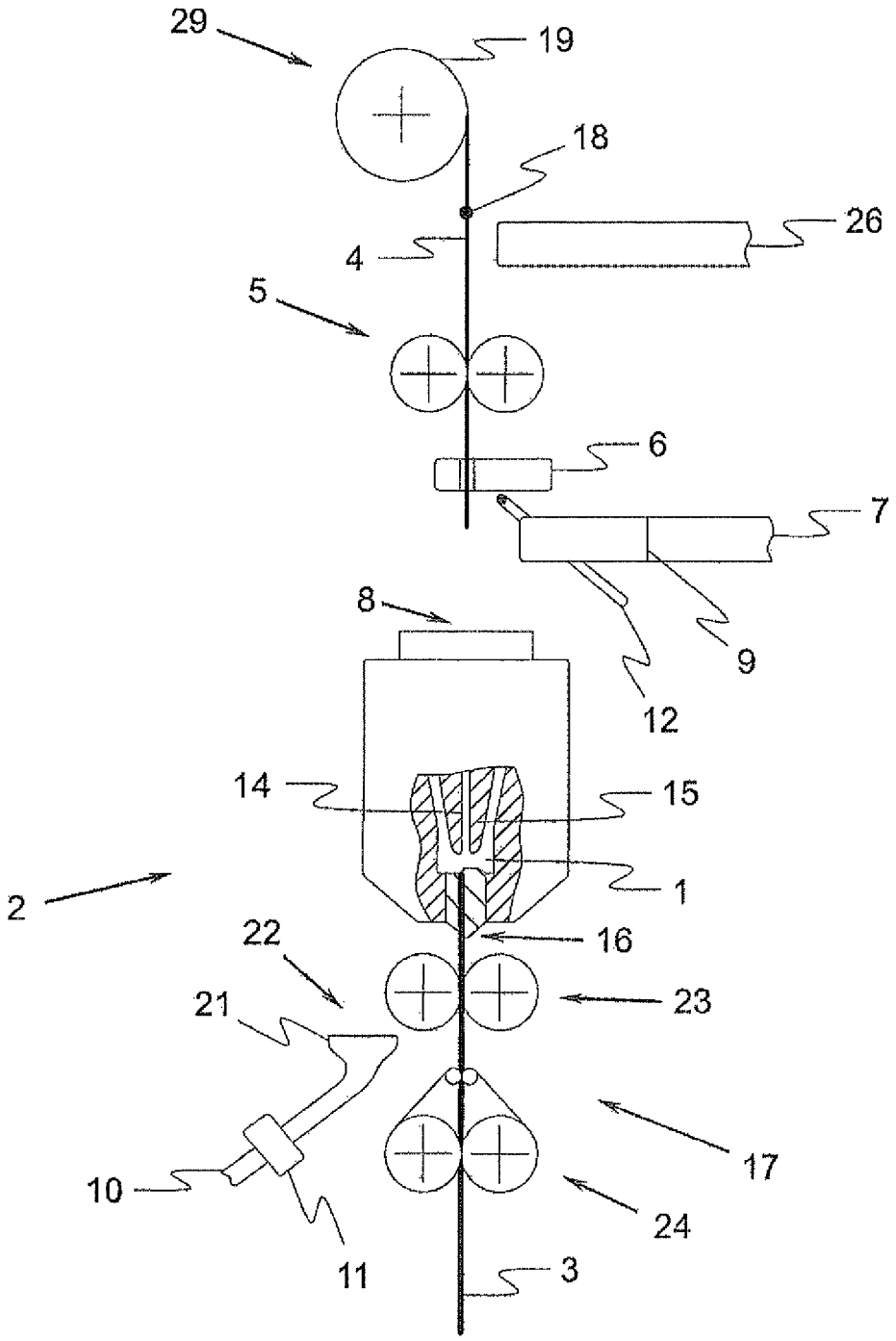

In particular in the case of air spinning, yarn faults 18 (FIG. 2) occur at regular intervals (defined as certain deviations from a given value in the monitored yarn parameters). The removal of such yarn faults 18 (so-called clearer cuts) is carried out in standard air jet machines by means of a service robot which patrols along the spinning stations 2, the service robot only being able to remove one yarn fault 18 per time slot while in addition having to proceed to the relevant spinning station 2 first. If more than one yarn fault 18 occurs simultaneously, the result is a loss in production, which then has a negative effect on the productivity of the entire air jet machine.

In order to counter effect this disadvantage, an air jet spinning machine is proposed within the scope of the present invention with the aid of which, in a particularly preferred embodiment, the above mentioned yarn fault 18 is carried out by the spinning station 2 itself. As a result, the yarn fault 18 can be removed at a number of spinning stations 2 simultaneously, as the spinning station 2 is no longer dependent on the service robot.

A possible embodiment of a corresponding spinning station 2 of an air jet spinning machine of the present invention is shown in FIGS. 1 to 11, in which the removal of the yarn fault 18 is depicted.

Subsequent to the yarn monitoring unit 6 detecting the passing of a yarn fault 18 (FIG. 2), the spinning process is at first interrupted. The interruption herein is carried out by means of a reduction in the feeding speeds of the delivery device 17, the withdrawal device 5 and the winding arrangement 29. Herein, the reduction has not to take place simultaneously or continuously. In any case, the respective feeding speeds should, however, be throttled in such a way that the stable spinning process breaks down due to the delivery speeds falling below their given limit values, and therefore that from a defined point in time no more yarn 4 is generated from the fibre strand 3. At this moment in time the yarn production is interrupted in that the yarn 4 detaches from the fibre strand 3 without the application of a separate force. For instance, this can be achieved in that the feeding speed of the delivery device 17 is reduced to such an extent that it can no longer supply a sufficient amount of fibre material for a yarn 4 to be formed. It is also possible to throttle the feeding speed of the withdrawal device 5 and/or the winding arrangement 29 slower than the feeding speed of the delivery device 17.

Figure 5:
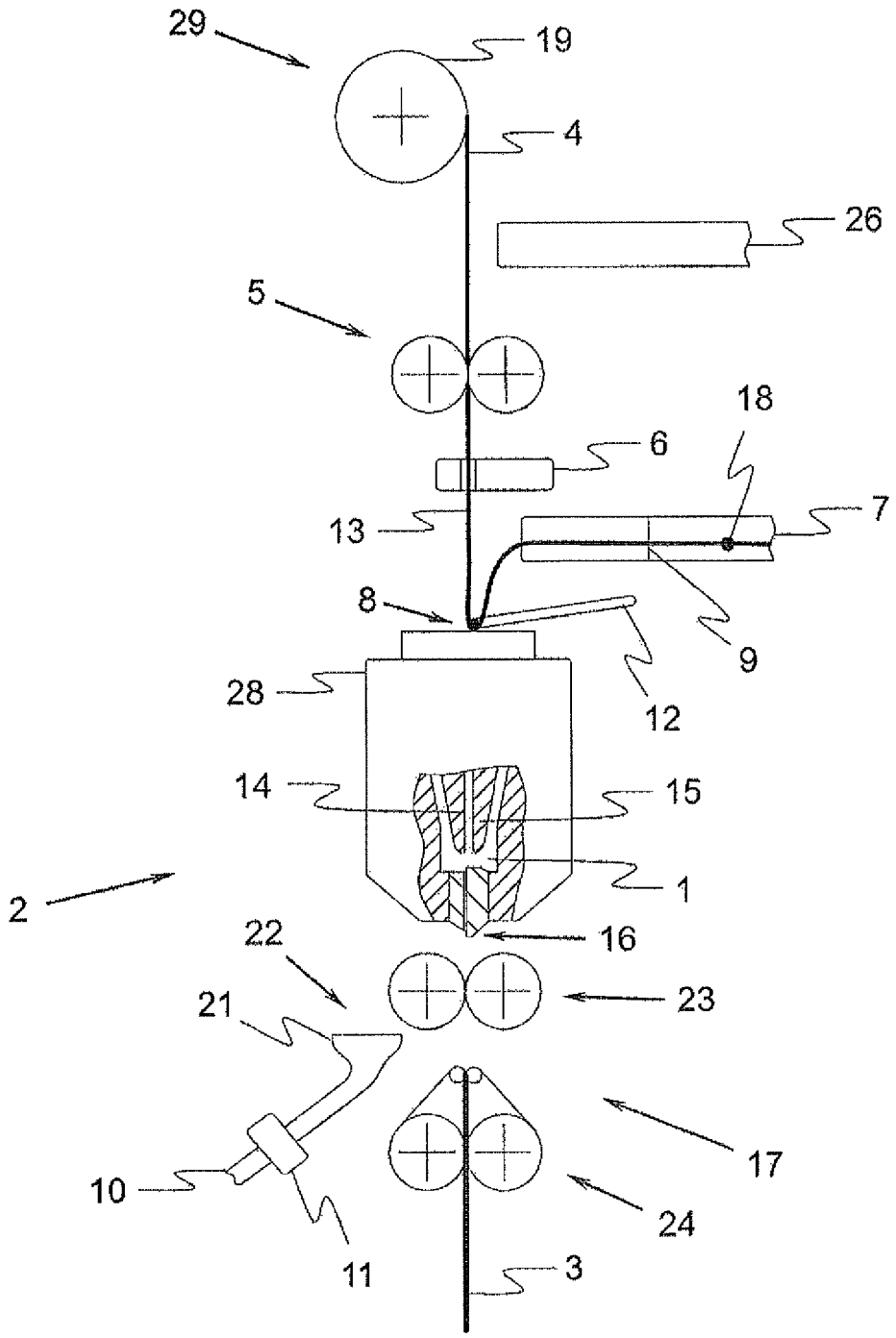

Subsequent to the standstill of the delivery device 17, the withdrawal device 5, and the winding arrangement 29, the objective is to locate the formed, winder-sided yarn end in an area between the withdrawal device 5 and the outlet opening 8 of the spinning nozzle 28 (FIG. 5). The yarn end is located in this case at a defined position and does not have to be searched for in a time-consuming process on the bobbin surface prior to re-starting the spinning process. Rathermore, the yarn end is located in the area of a first suction unit 7 of the spinning station 2 and can be suctioned by the suction unit 7 in the manner of the present invention.

The first suction unit 7 is located preferentially between the outlet opening 8 and the withdrawal device 5, or respectively, the yarn monitoring unit 6. If the first suction unit 7 is connected to a vacuum source (not shown), for instance by means of opening a valve, the yarn end is sucked in. When the withdrawal device 5 and the winding arrangement 29 are driven simultaneously in the opposite direction to the spinning direction, the section of the yarn 4 containing the yarn fault 18 reaches the first suction unit 7 (FIG. 4).

Figure 4:
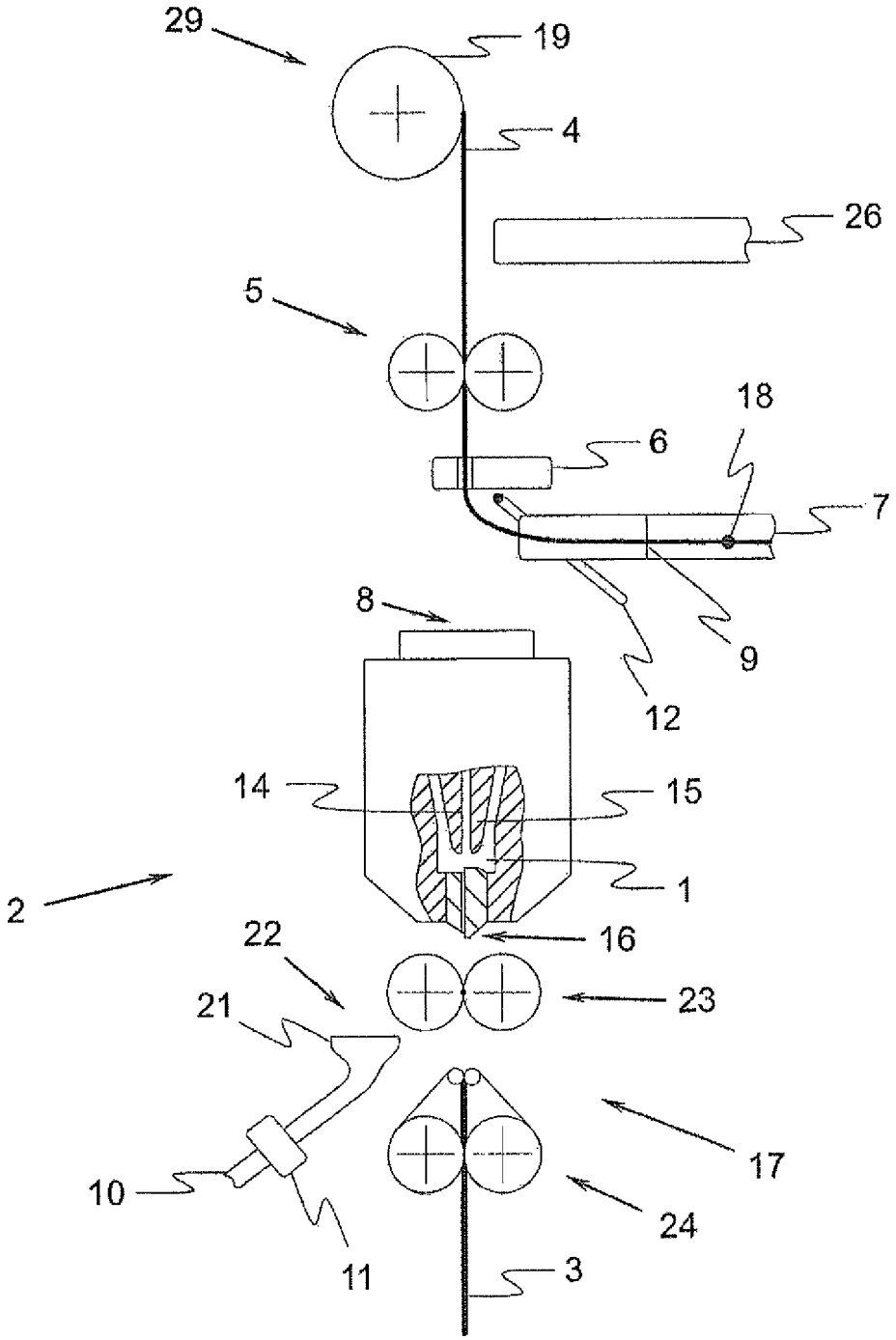

In the following, the yarn manipulator 12 (for example in the form of a swivel mounted pivot lever) is now set in motion, which yarn manipulator moves the yarn 4 into the area of the outlet opening (FIGS. 4 and 5). In order to enable the formation of the yarn loops 13, or respectively, to make available a sufficient quantity of yarn, as shown in FIG. 5, the winding arrangement 29 and the withdrawal device 5 herein continue to be driven in the opposite direction of the spinning direction. It is of course also possible that the necessary quantity of yarn for the formation of the loops can be drawn from the first suction unit 7.

Figure 6:
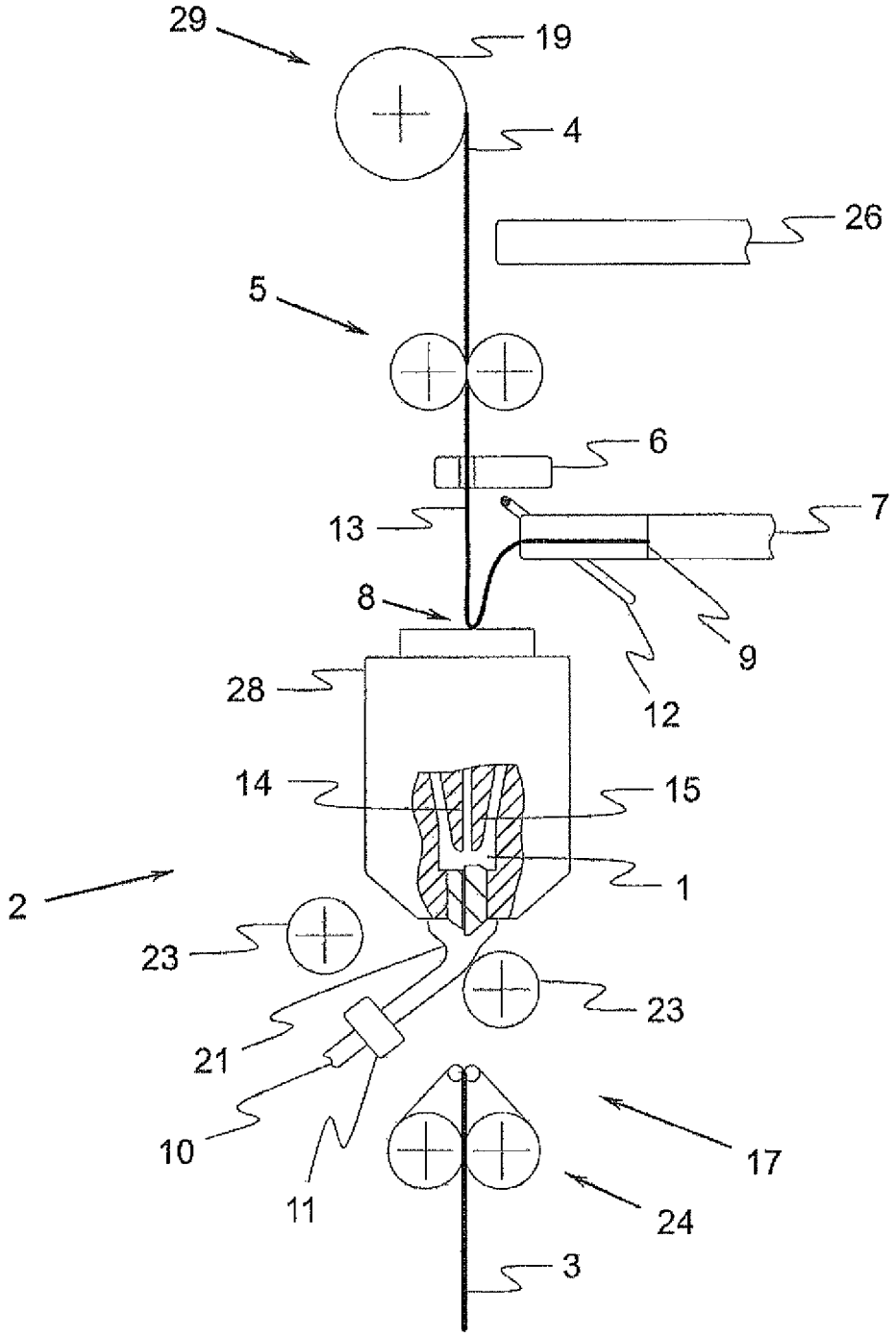

In any case, it should be ensured that the yarn fault 18 in the stage shown in FIG. 5 is located behind a yarn cutting unit 9 (which for instance can be integrated in the first suction unit 7), in order to be able to have said yarn fault 18 cut from the rest of the yarn 4 and to be suctioned by the first suction unit 7 (FIG. 6).

Figure 7:
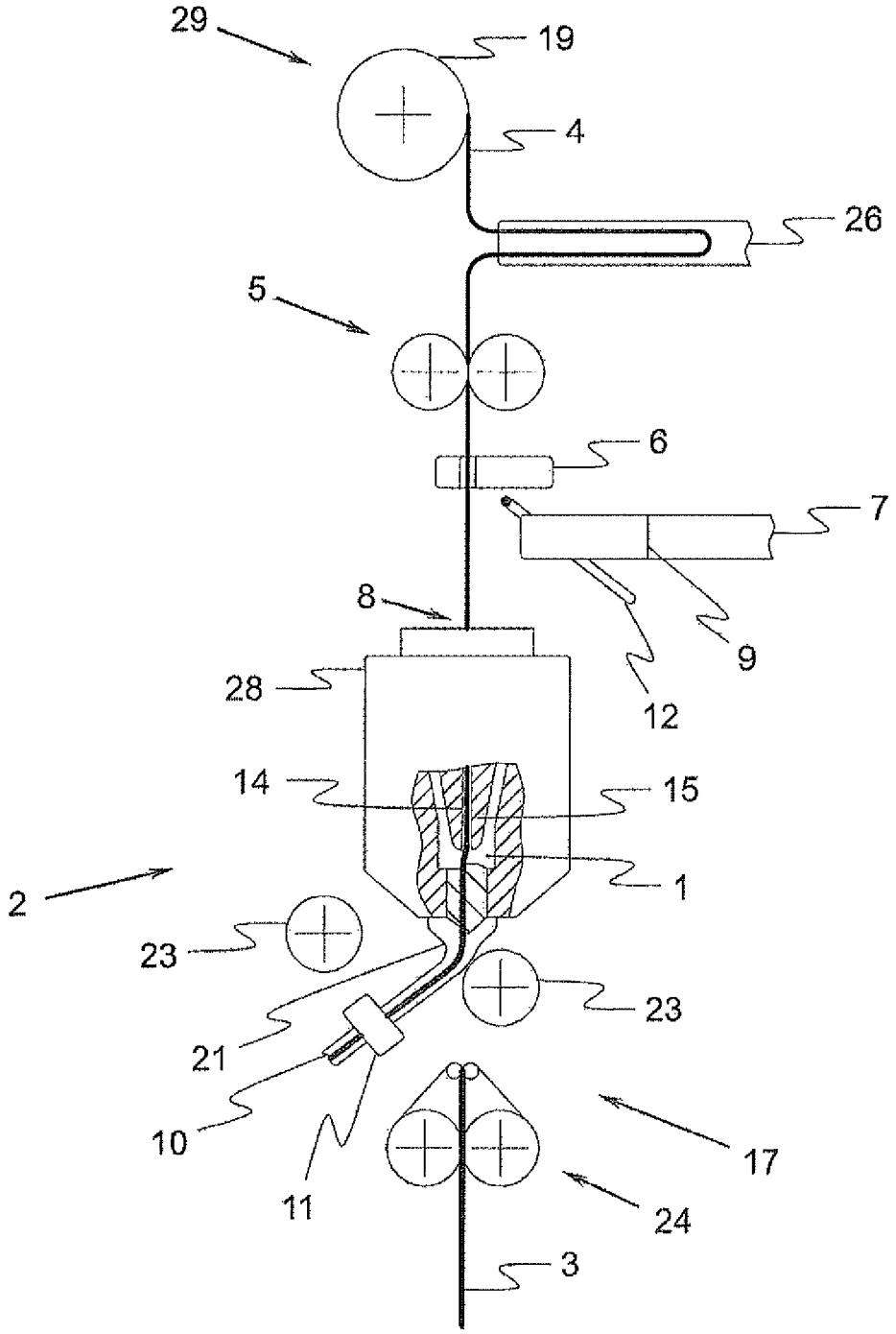

When the vortex chamber 1 is subjected to a low pressure subsequent to the cutting of the yarn fault 18 (this can for instance be generated with the aid of a second pivoted suction unit 10 in the area of the inlet opening 16 of the vortex chamber 1), the yarn end reaches the yarn forming element 15 via the outlet opening 8 and from there via the vortex chamber 1 and the inlet opening 16 to the area of the second suction unit 10 (FIG. 7). The reverse feed of the yarn end can herein be effected by the low pressure generated by the second suction unit 10, and/or by means of an air stream generated by corresponding air injection nozzles 32 (connected to a low pressure source which is not shown) (see FIG. 24), wherein just one air injection air nozzle 32 can be sufficient, the air injection nozzles 32 extending in the opposite direction to the spinning direction in the withdrawal channel 14 and generating an air stream in the direction of the inlet opening 16. Alternatively, or in addition thereto, it is possible to provide air channels that lead into the withdrawal channel 14 and with the aid of which the withdrawal channel 14 is connectable to a low pressure source.

In a particularly advantageous embodiment, it is required that the yarn end, as shown in FIG. 7, is suctioned by the second suction unit 10 subsequent to the return feed through the vortex chamber 1 and accordingly fixed. In order to be able to provide a direct (preferentially airtight) contact between the spinning nozzle 28 and the suction nozzle 21 of the second suction unit 10, at least one roller of the front roller pair 23 of the delivery device 17 can be designed as a swivel-mounted part. The respective roller can in this case be swiveled from a spinning position (FIG. 5) into a piecing position (FIG. 6), in which the inlet opening 16 for the suction nozzle 21 is more easily accessible. In this case, it is also advantageous when the suction nozzle 21 is movable (for instance pivotable) from one spinning position (FIG. 5) into a first piecing position (FIG. 6). The suction opening 22 of the suction nozzle 21 can be brought directly to the area surrounding the inlet opening 16 of the spinning nozzle 28 into a sealed contact with same.

Figure 8:
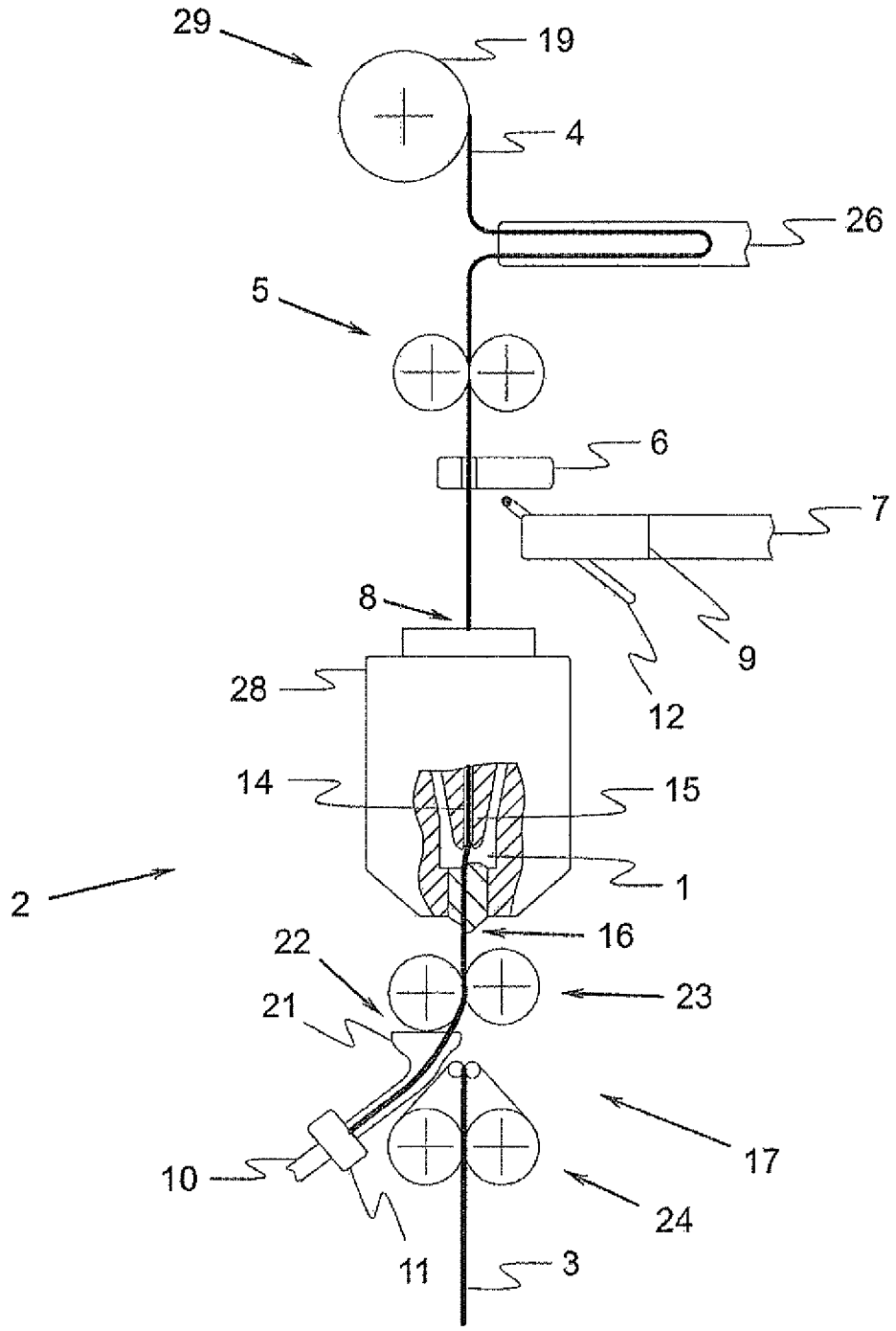
Figure 9:
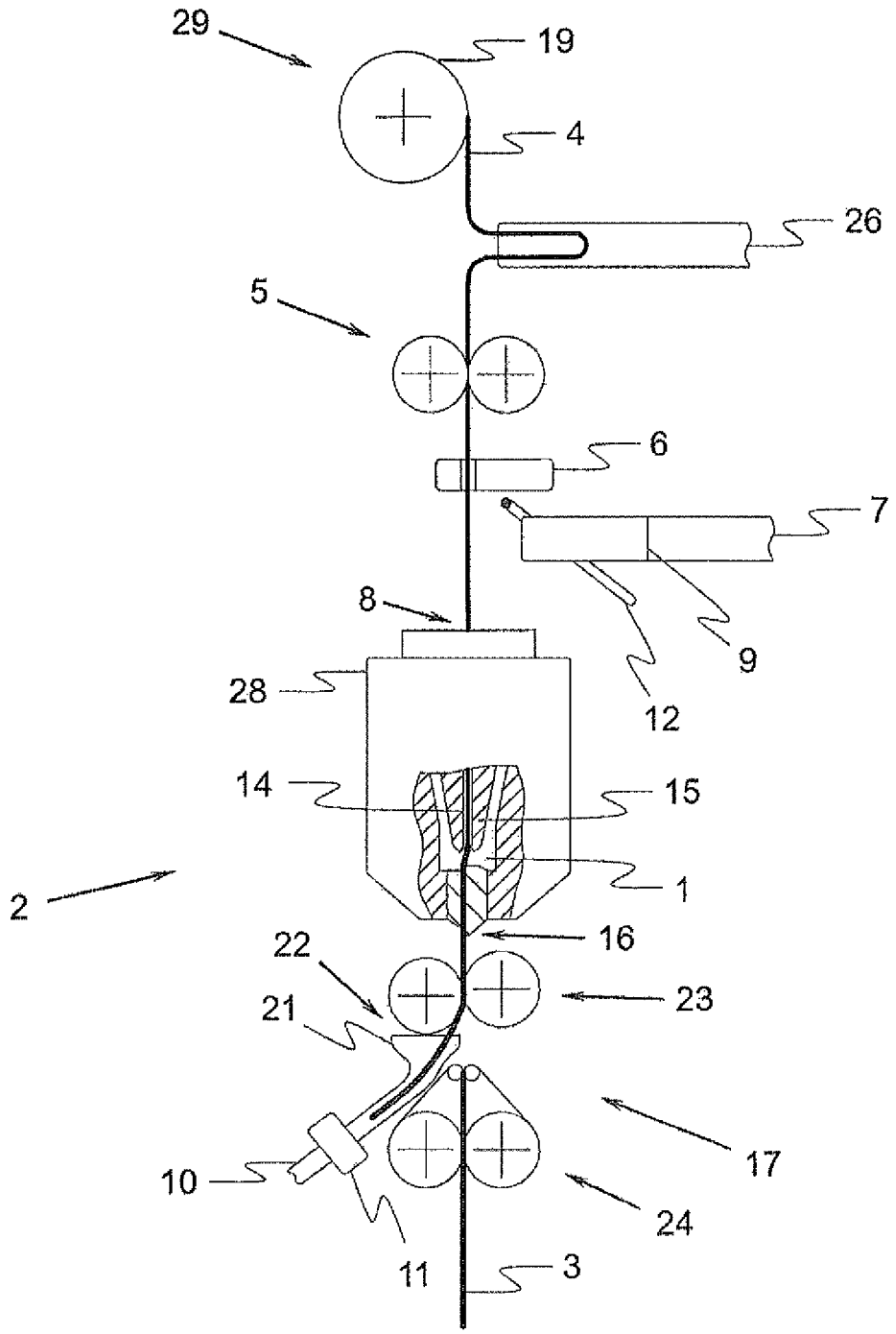

In the next step, the preparation of the yarn end for the following piecing process takes place (that is, for the joining of the yarn end with the end section of the fibre strand 3). The yarn preparation (cutting the end section, thinning out of the new yarn end, etc.) takes place herein for instance in a yarn end preparation device 11, which advantageously is located in the suction path of the suction nozzle 21, so that the yarn end is guided through the yarn end preparation device 11 and can be cut to the desired length during the preparation (depending on the distance between the yarn end preparation device 11 and the inlet opening (16) (FIG. 8).

During the yarn end preparation, a defined yarn quantity can be stored intermediately within a yarn storer 26 (for instance a pneumatically functioning one), wherein the necessary yarn quantity can be made available for example by means of reverse rotation of the bobbin 19.

In the next step the withdrawal device 5 and the winding arrangement 29 are put into operation again, wherein the quantity of yarn in the yarn storer 26 permits a varying acceleration of the respective unit, or compensates it. In order to prevent a premature exit of the yarn end out of the suction nozzle 21 of the second suction unit 10, the suction nozzle 21 can be equipped with a yarn brake (not shown), so that the yarn end is only then drawn out of the suction nozzle 21 when the yarn storer 26 is emptied. At this point in time, the air stream required during the spinning process again prevails within the vortex chamber 1, so that the yarn 4 passing through the withdrawal channel 14 is already receiving the required twist. At this stage, it is additionally advantageous when the suction nozzle 21 of the second suction unit 10 is already located in a second piecing position, wherein the suction opening 22 of same is located between the withdrawal roller pair and a delivery section 24 of the delivery device 17 upstream of the withdrawal roller pair. In this case, the yarn end is superimposed in a controlled manner on the fibre strand when it is inserted back into the vortex chamber 1 and guided at this.

Figure 10:
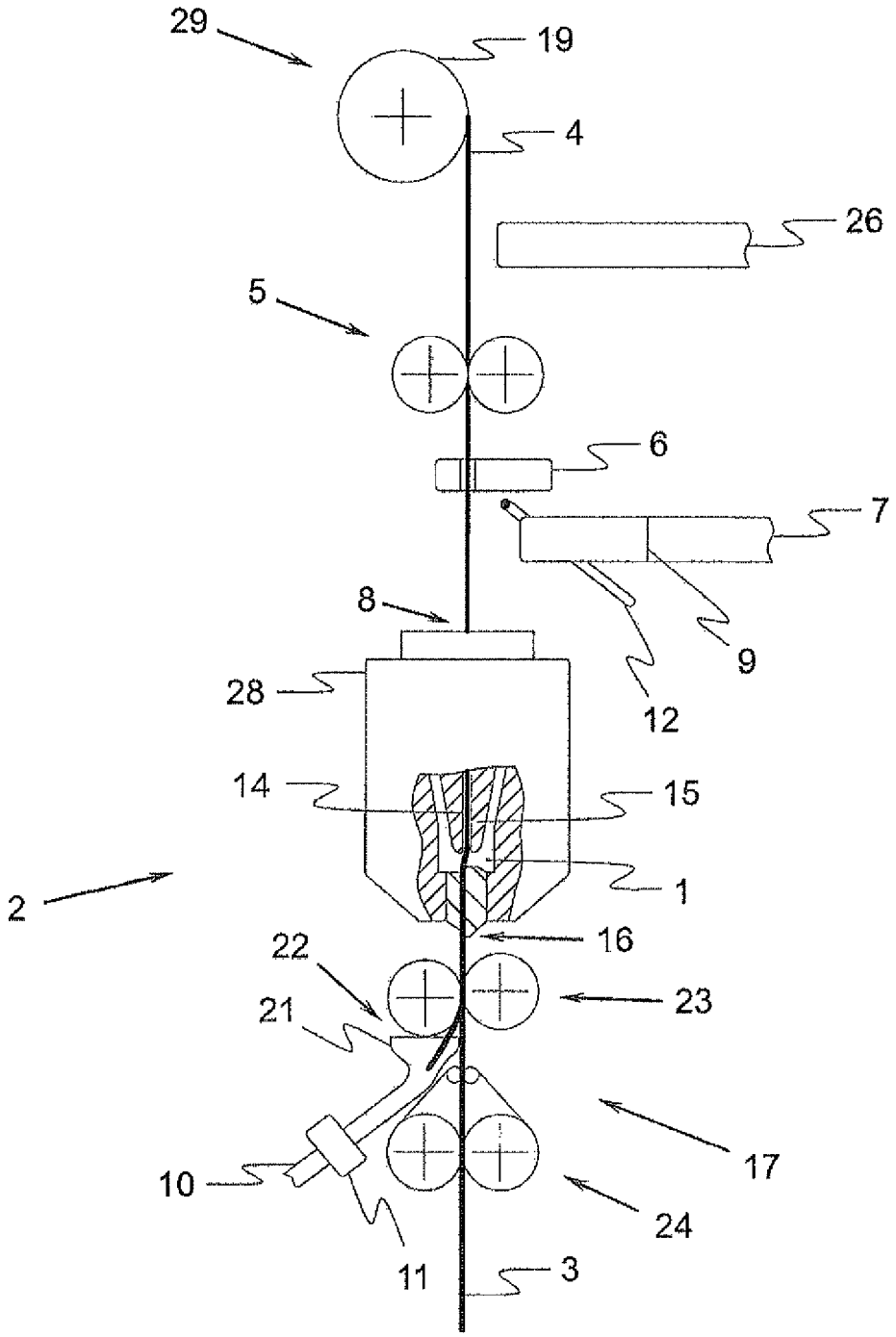
Figure 11:
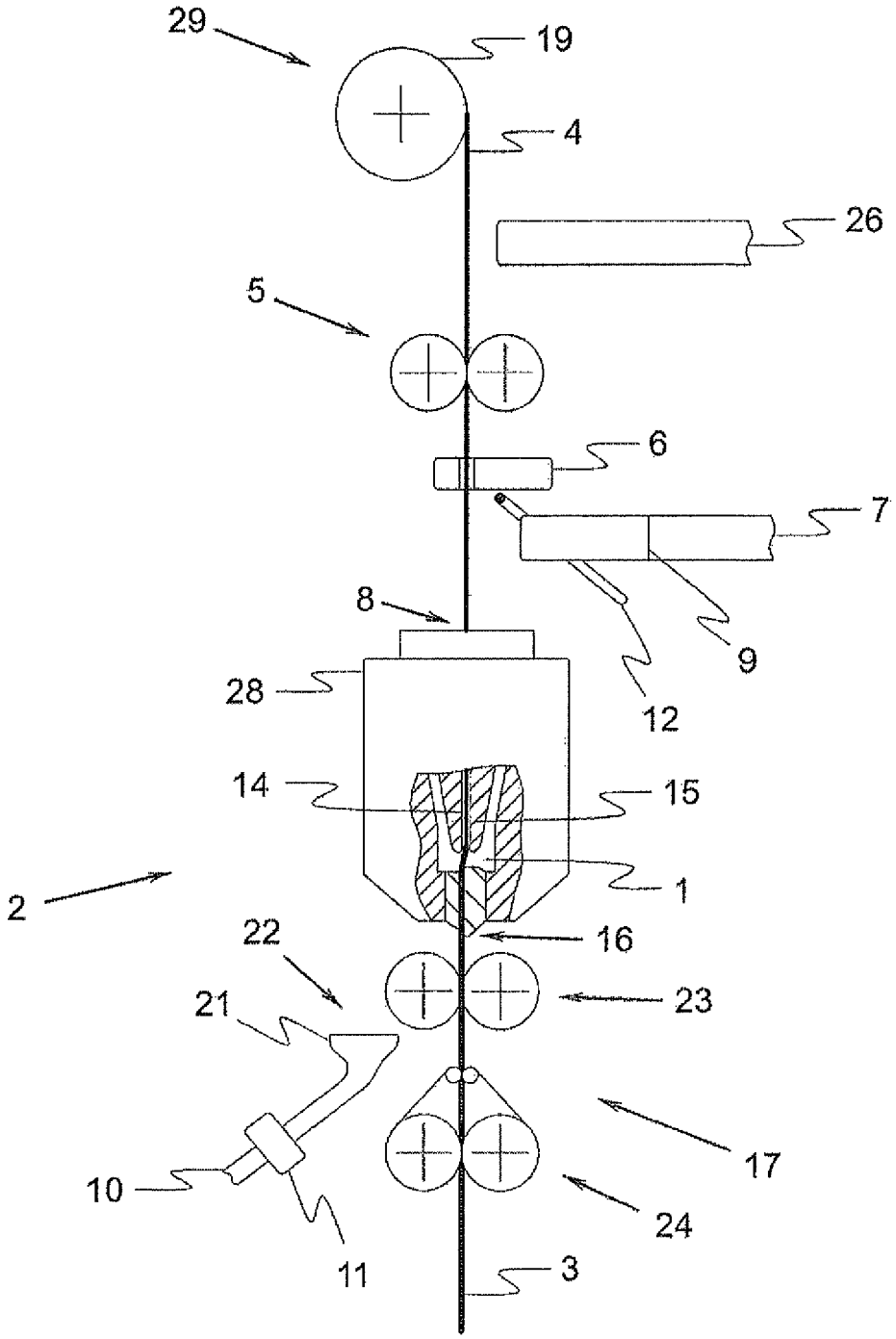

When the yarn end is detected by a sensor which is not shown (which can be placed for instance in the area of the suction nozzle 21), the delivery device 17 is also put into operation, so that a superimposition of the prepared yarn end and the end section of the fibre strand 3 occurs, wherein yarn end and fibre strand 3 are guided by the front roller pair 23 (FIG. 10). The spinning nozzle 28 also passes this area, whereby the piecing process is completed.

As a result, a clearer cut takes place at the spinning station itself, in which no service robot is involved. The spinning process can proceed as normal, wherein the suction nozzle 21 of the second unit 10 as well as both rollers of the withdrawal roller pair are located again in their spinning positions.

Alternatively, it is of course possible to carry out the yarn end preparation, prior to the piecing process, not by a yarn end preparation device 11 assigned to the spinning station, but rather manually by service personnel or by means of a service robot 27 (FIG. 13), that patrols back and forth along a number of spinning stations 2. In so doing, the above mentioned second suction unit 10 can thus be dispensed with as, subsequent to the reverse guiding through the vortex chamber 1, the yarn end is either gripped by the service personnel or a service robot 27, prepared for the piecing process, and finally brought into contact with the fibre strand 3.

The FIGS. 12 to 16 show a potential bobbin change in an air jet spinning machine of the present invention. While a clearer cut must be carried out relatively often, a bobbin change is only necessary when the bobbin 19 is full. A service robot 27 can be applied for changing the bobbins, without the productivity of the air jet spinning machine being significantly reduced.

Figure 12:
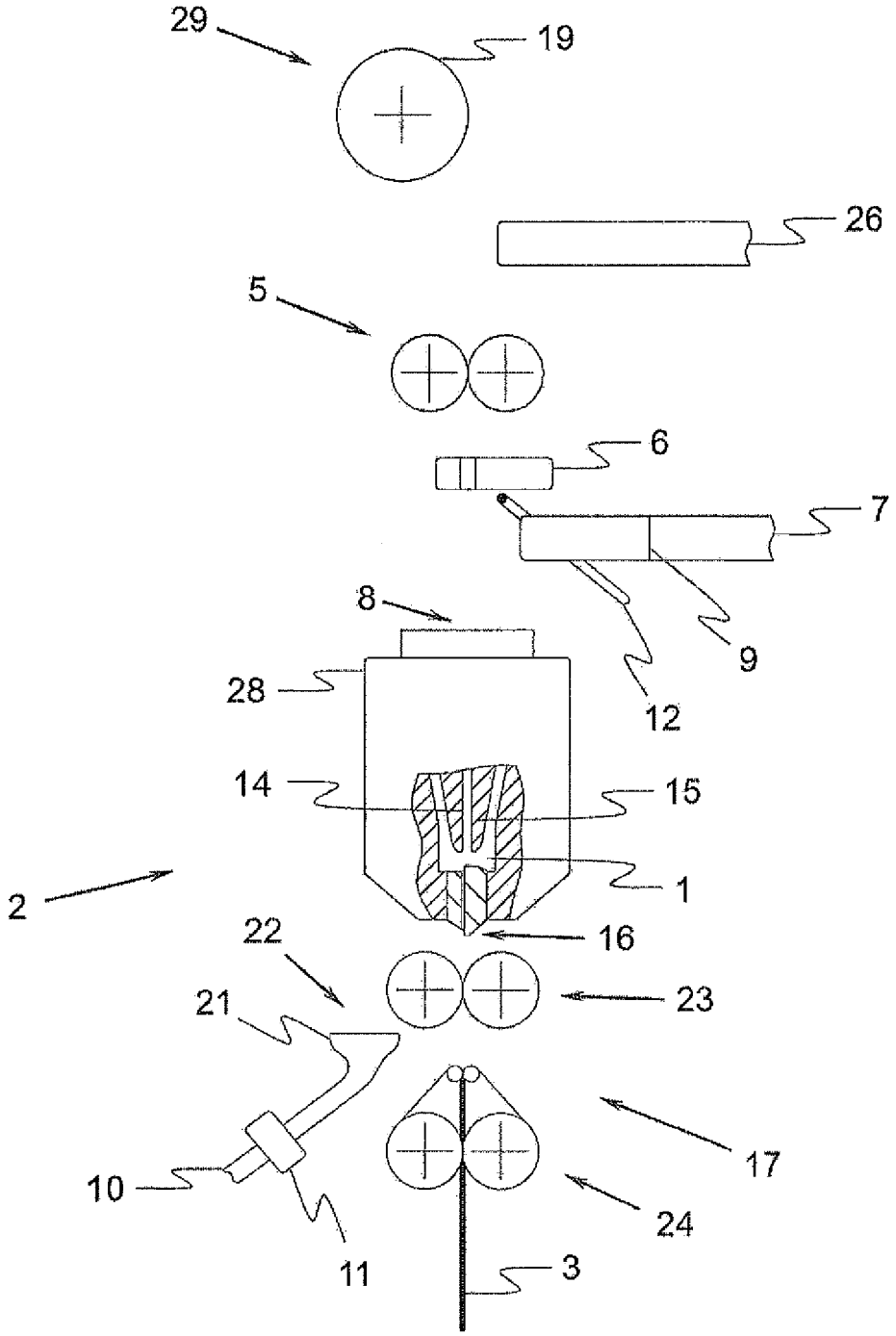
FIGS. 12 to 16 are schematic depictions of the bobbin change according to the present invention with the aid of a service robot.
Figure 13:
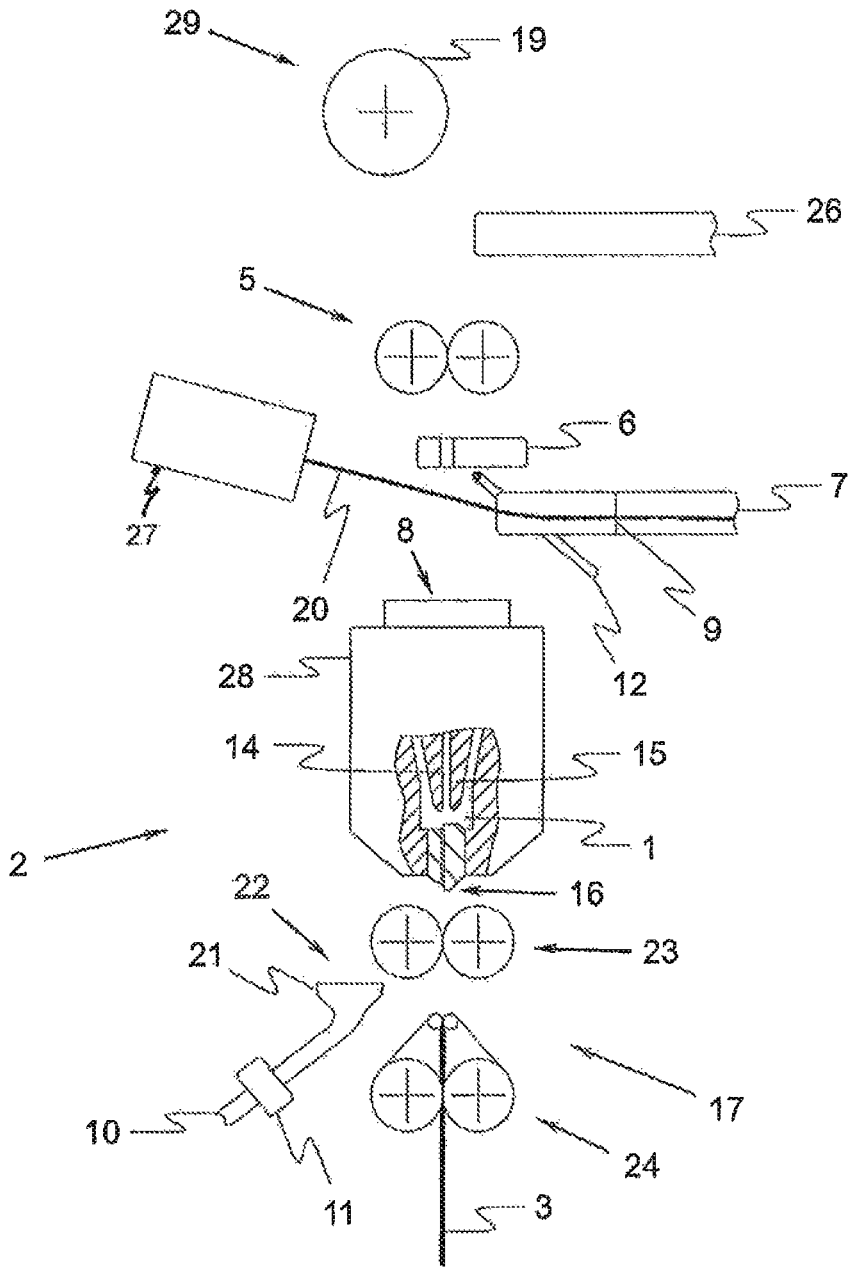

When a full bobbin 19 is detected with a sensor, the spinning process is interrupted in the manner described above, wherein the yarn end is wound onto the bobbin 19 (FIG. 12). In contrast to the piecing process described above, the yarn end is in this case not attached to the fibre strand 3. Rathermore, a separate piecing yarn 20 serves the piecing process, said separate piecing yarn 20 being provided to the spinning station 2 by a service robot 27 in the area of the first suction unit 7. The first suction unit 7 suctions the end section of the piecing yarn 20, so that a situation arises as shown in FIG. 13. Subsequent to the suctioning of the piecing yarn 20, the piecing process takes place, as described in principle in connection with the FIGS. 1 to 11.

Figure 14:
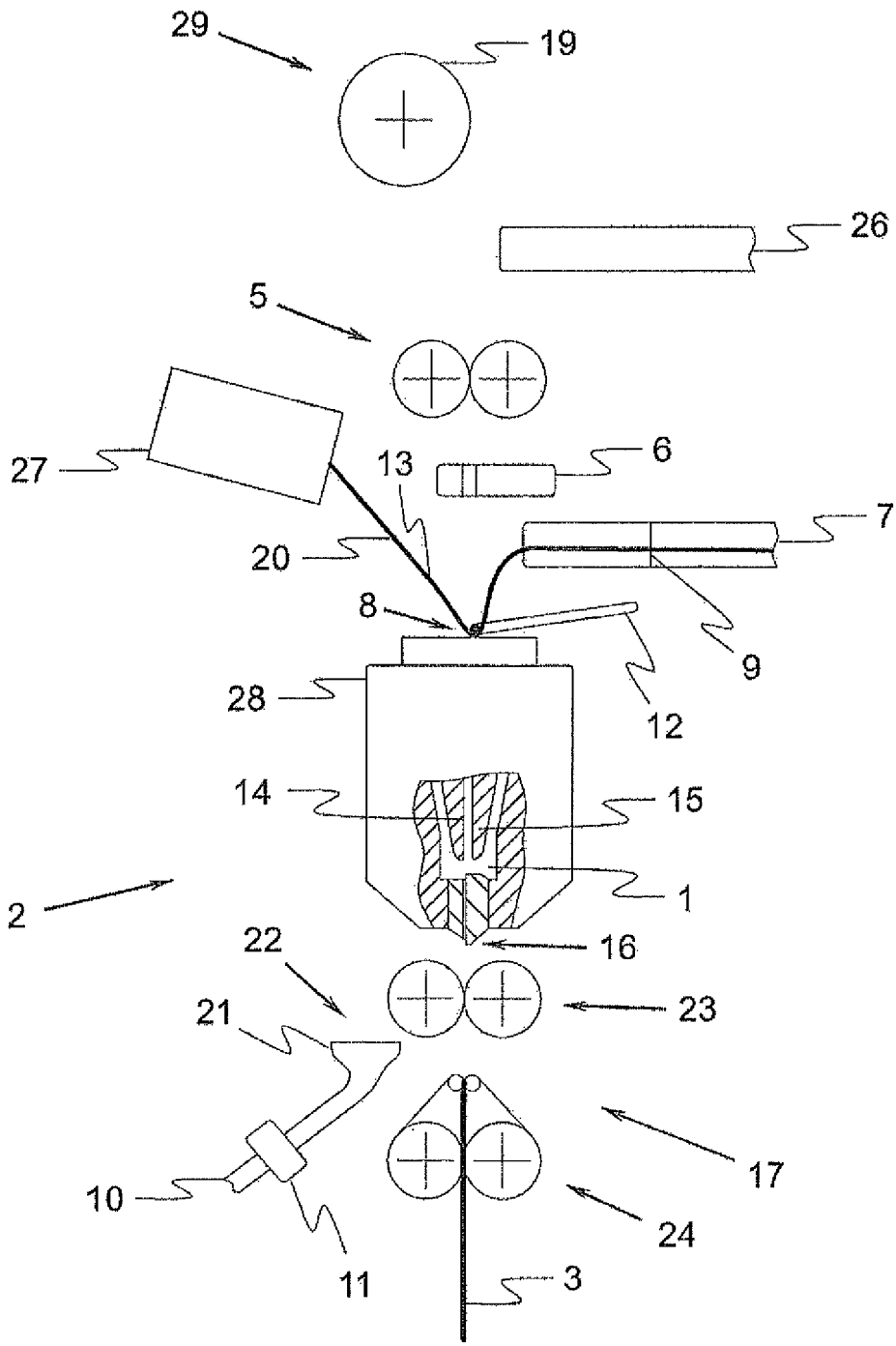
Figure 15:
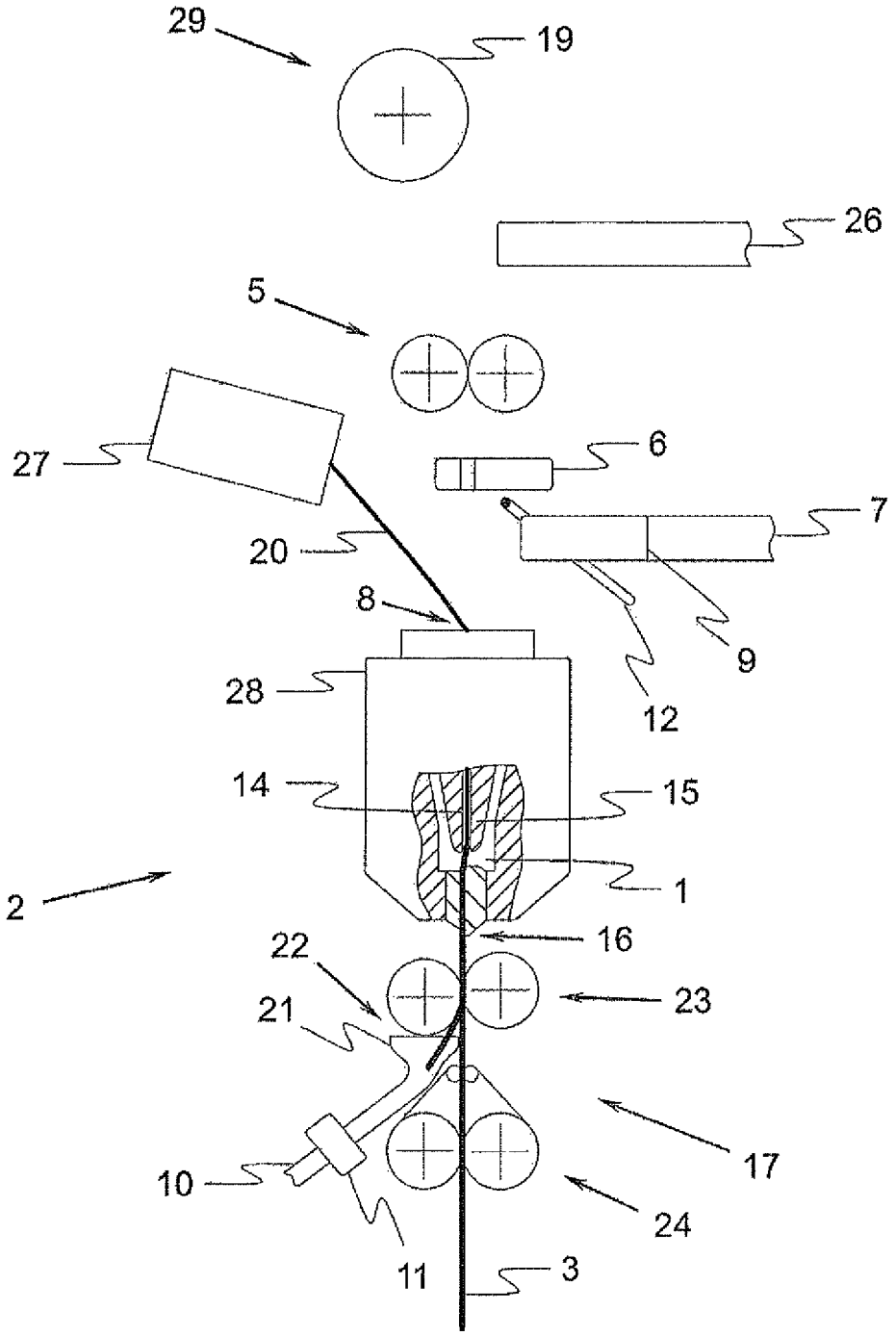

The piecing yarn 20 is brought into the area of the outlet opening 8 of the spinning nozzle 28 with the aid of a yarn manipulator 12 assigned (preferably) to the spinning station 2 (FIG. 14). Subsequently, the suctioning of the end section of the piecing yarn 20 with the aid of the second suction unit 10, the yarn end preparation, the superimposition of the end section of the fibre strand 3 (FIG. 15) and the return guiding through the vortex chamber 1, take place.

Figure 16:
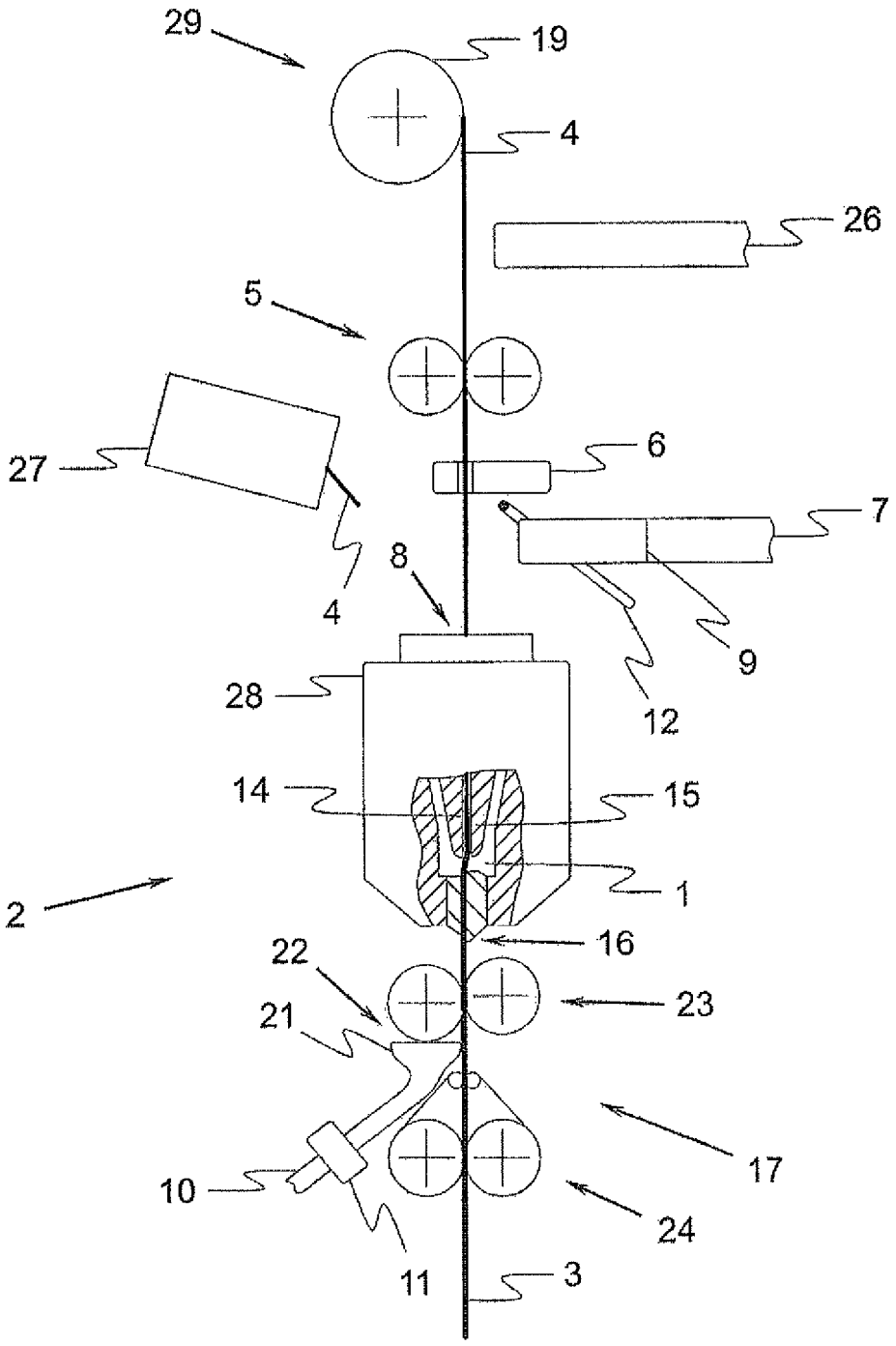

The yarn 4 is subsequently cut by the service robot 27 (or by means of the spinning station's own yarn cutting unit 9), the full bobbin 19 is replaced by an empty one, and the remaining yarn end is wound onto the empty bobbin 19 (FIG. 16).

If the piecing process succeeds, the actual spinning process can then be continued. If the piecing process fails, the service robot 27 provides a new piecing yarn 20 and the above described steps are repeated until the piecing process is successfully completed.

Figure 17:
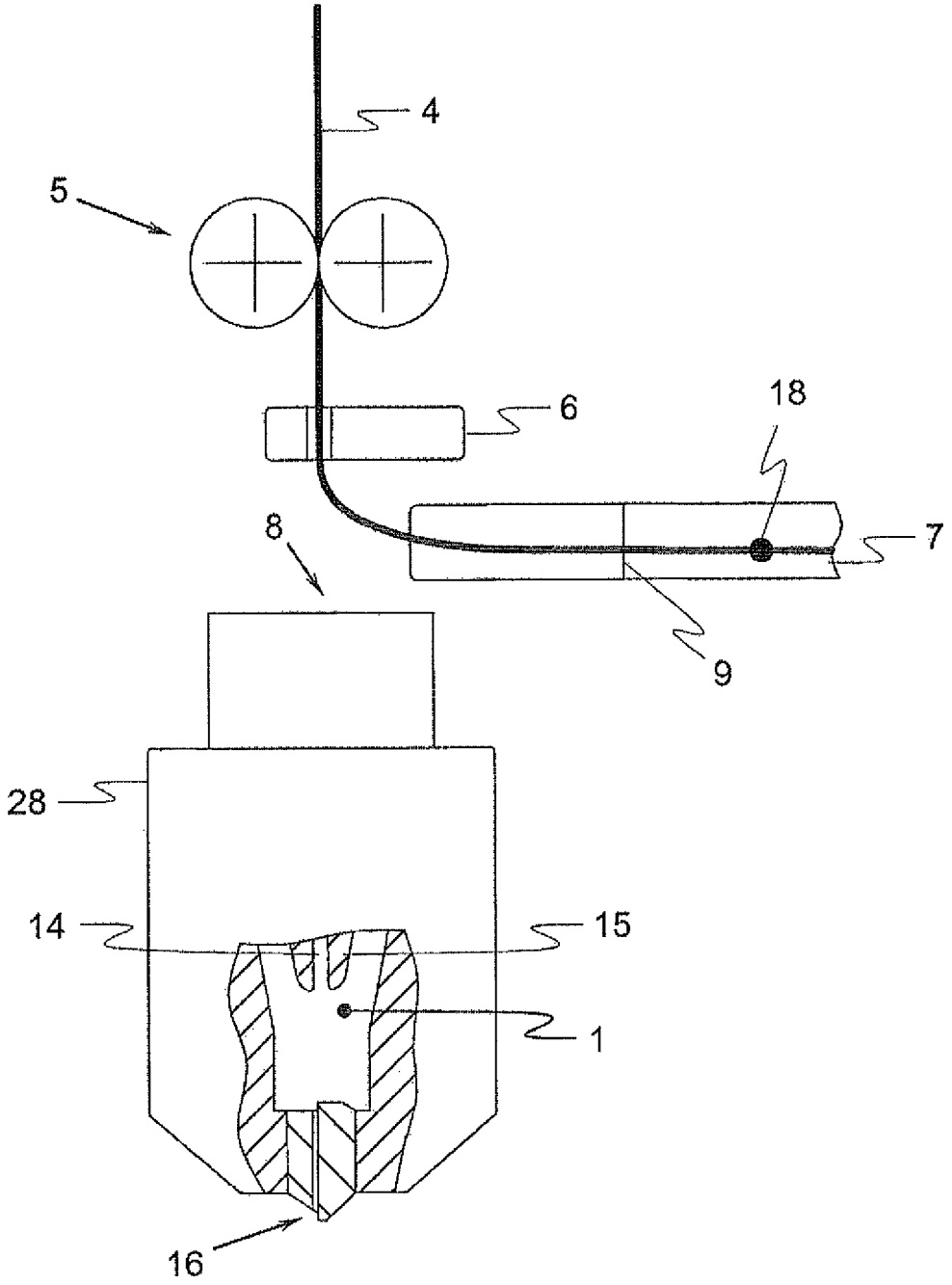
FIG. 17 is a possible embodiment of a yarn forming element.

While in the above embodiments a yarn manipulator 12 is repeatedly shown which moves the yarn 4 from the first suction unit 7 in the direction of the outlet opening 8 of the spinning nozzle 28, it is, either alternatively or in addition thereto, possible to design the yarn forming element 15 as a moving component. The advantage of this type of solution is shown in a comparison to FIG. 17 (a yarn forming element 15 axially extending in the spinning direction) with the embodiment in FIG. 14, in which no axial movement is provided. While a yarn manipulator 12 is necessary in FIG. 14, in order to move the yarn 4 to the outlet opening 8, the distance between the outlet opening 8 and the first suction unit 7 can be reduced in such a way in the case of FIG. 17, that the yarn end, subsequent to the cutting off of the yarn fault 18, can be suctioned reliably by the spinning nozzle 28 even without additional process or handling devices (provided that a low pressure is generated therein).

Figure 18:
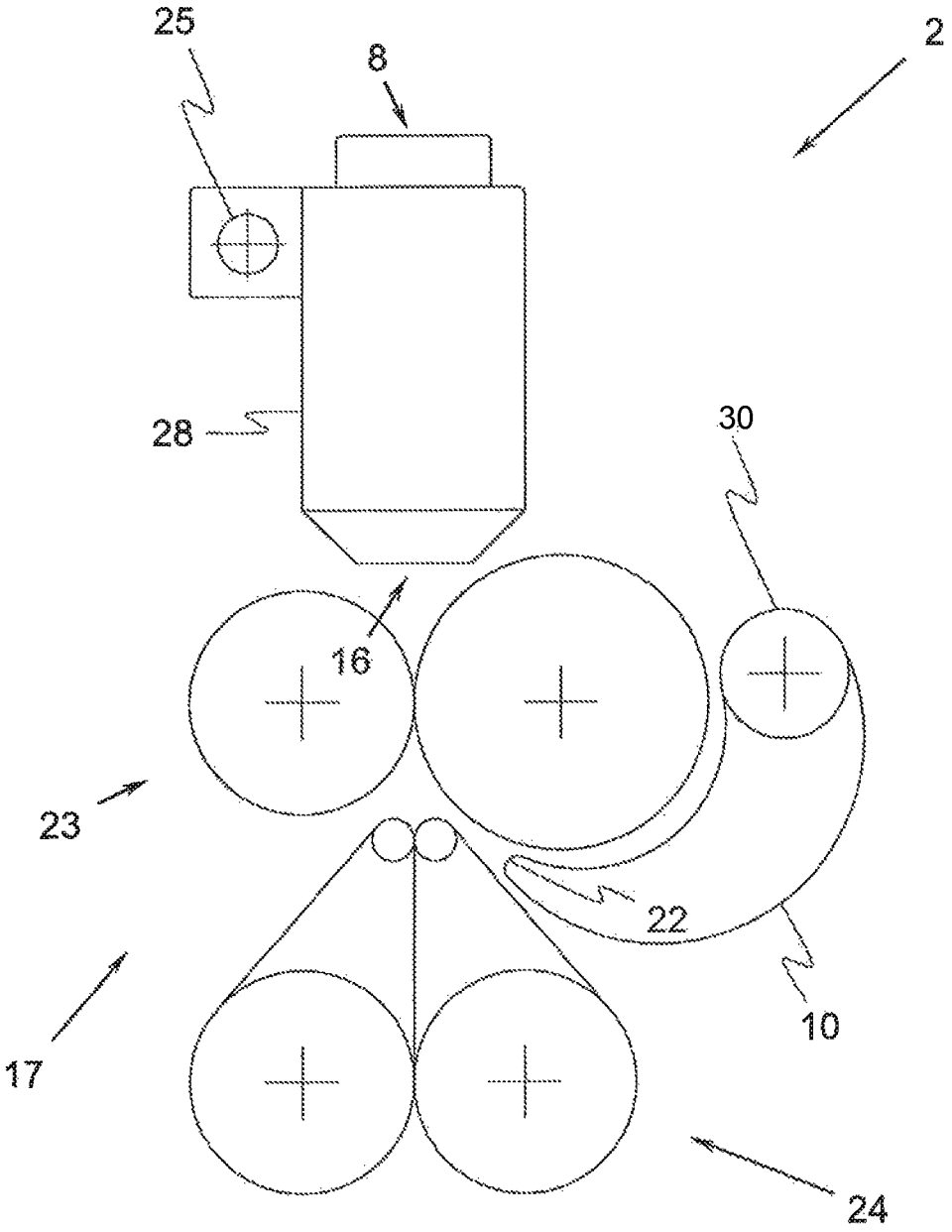
FIG. 18 is a schematic depiction of a section of the spinning station of an air jet spinning machine according to the present invention.
Figure 19:
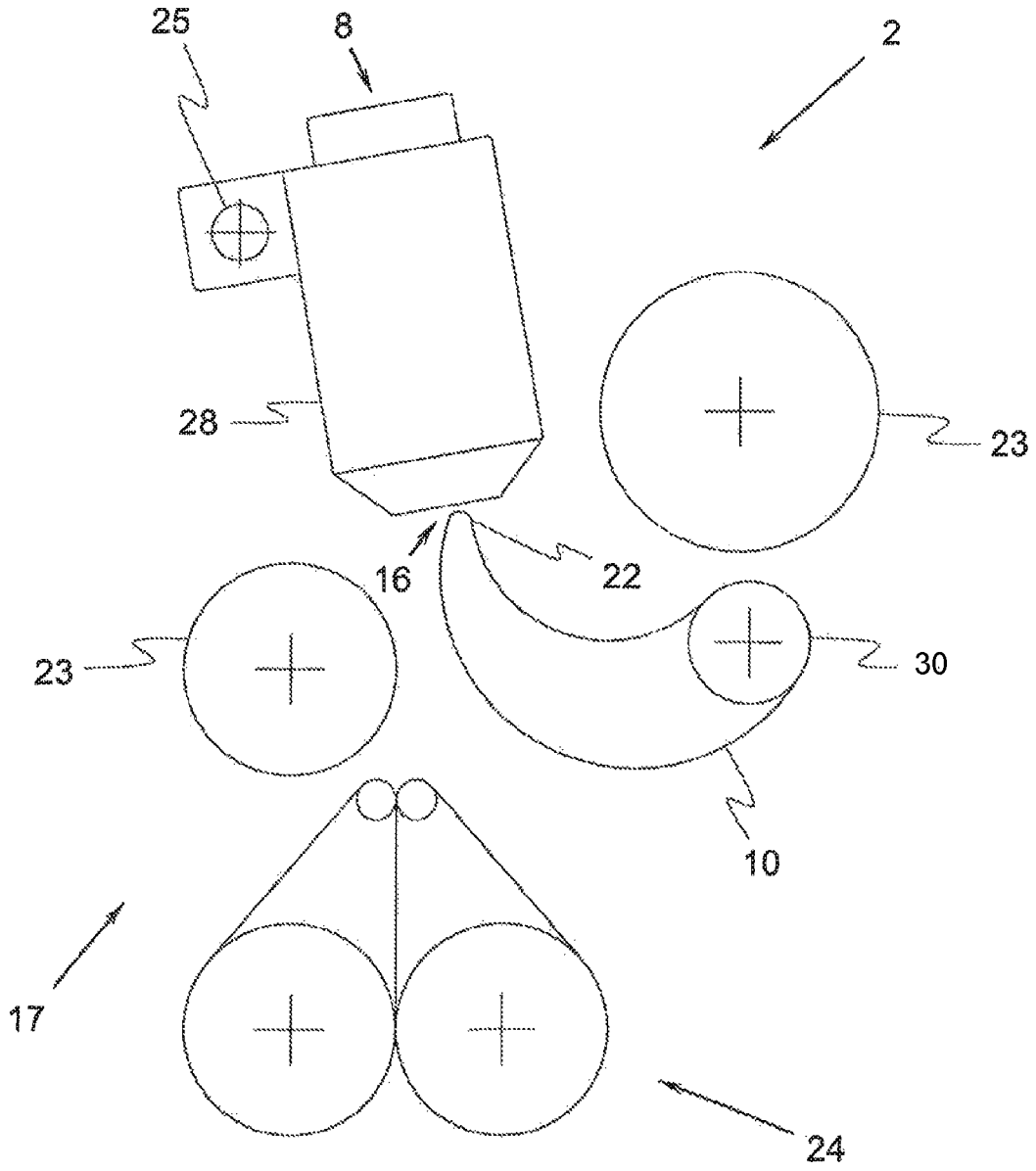
FIG. 19 is a view according to FIG. 18 with a swiveled spinning nozzle and a swiveled second suction unit.

A further advantageous development of the present invention is depicted in the FIGS. 18 and 19. As shown in the drawings, it can also be advantageous when, in addition to the pivoting abilities of the suction nozzle 21 of the second suction unit 10 and at least one roller of the front roller pair 23, the spinning nozzle 28 itself is pivotable around a rotational axis 25. By these means, it is possible to bring the suction opening 22 of the suction nozzle to form a seal with the inlet opening 16 of the vortex chamber 1 so that the yarn end can be suctioned and fed to the yarn end preparation device 11 (not shown in FIGS. 18 and 19).

Figure 20:
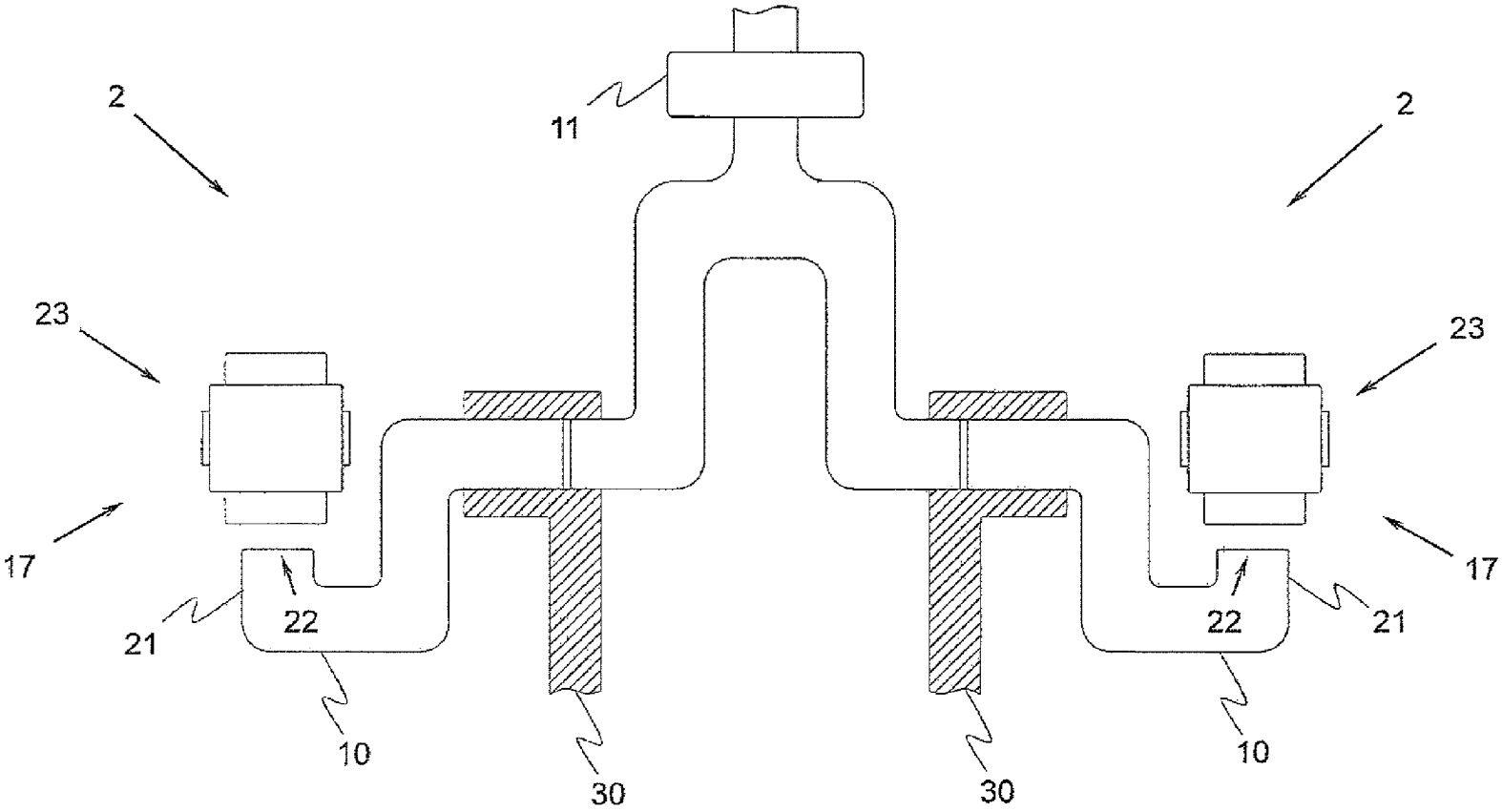
FIG. 20 is a schematic depiction of a section of two spinning stations of a further air jet spinning machine according to the present invention.

Furthermore, it is possible to assign a yarn end preparation device 11 to two adjacent spinning nozzles 28. FIG. 20 shows an optional embodiment. As shown in FIG. 20, the suction nozzles 21 of the two second suction units 10 run into a joint yarn end preparation device 11, wherein the suction nozzle 21 in turn can be supported in a corresponding bearing 30 in a pivotable manner (compare FIGS. 18 and 19).

Figure 21:
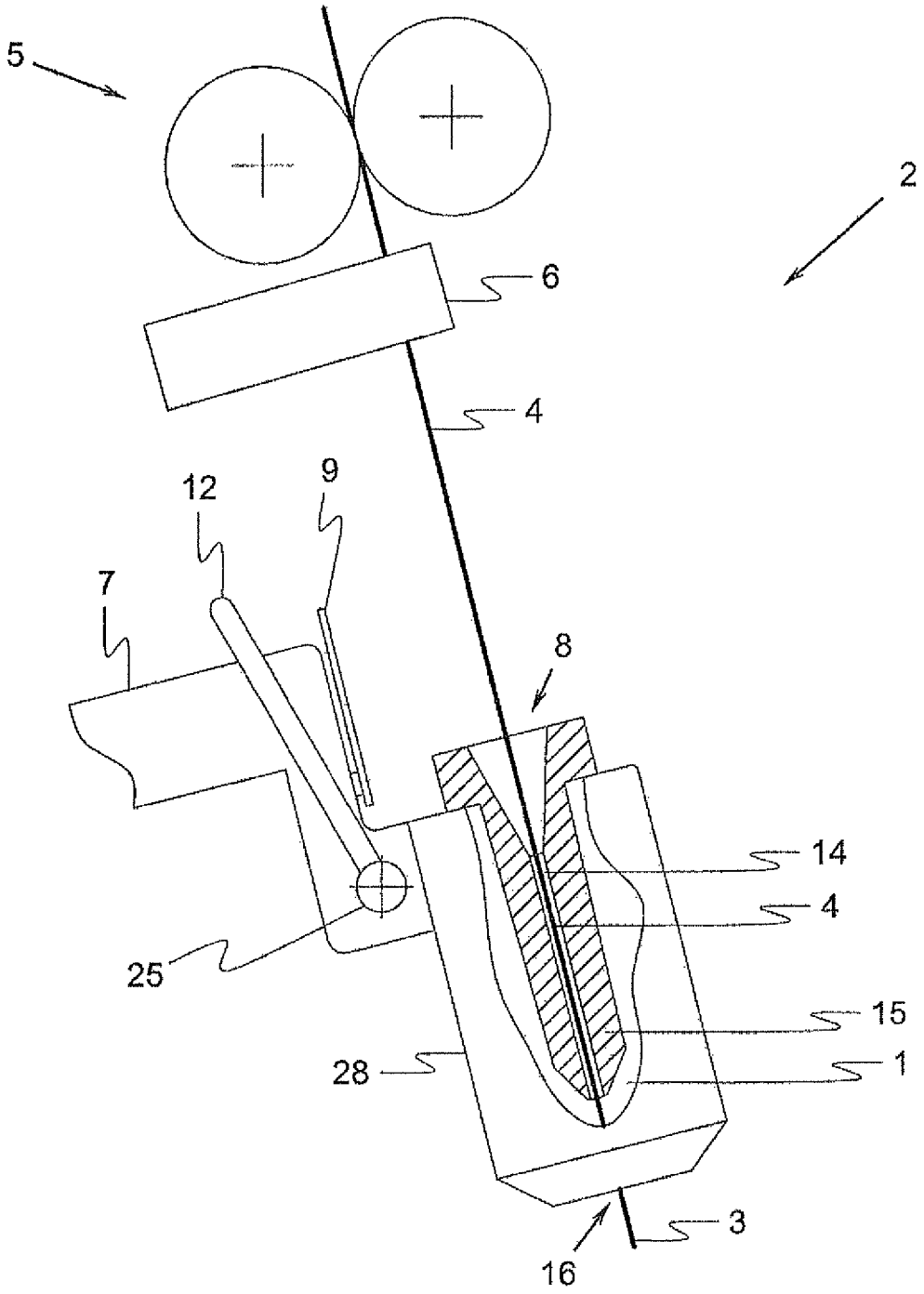
FIG. 21 is a schematic depiction of a section of the spinning station of a further air jet spinning machine according to the present invention.
Figure 22:
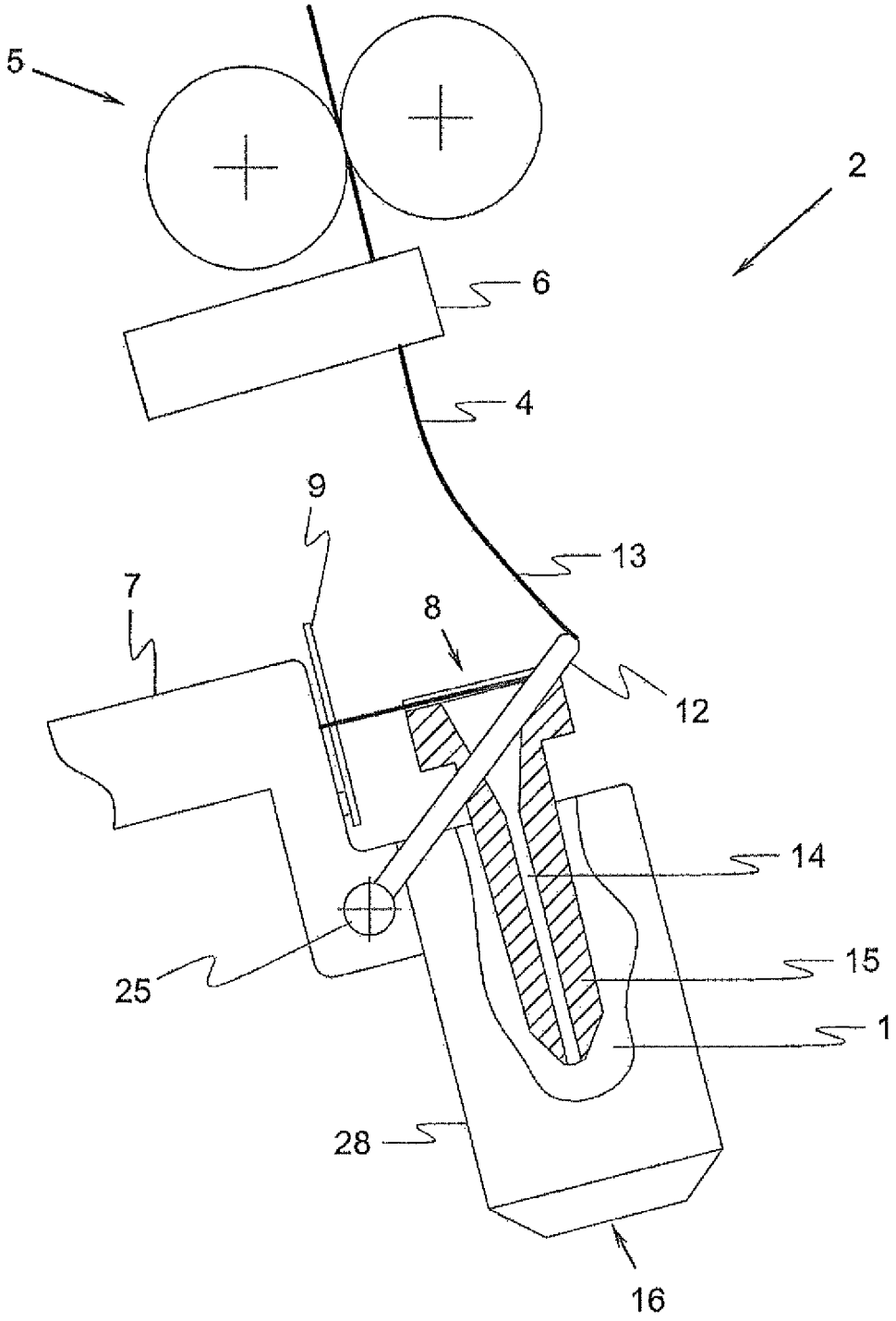
FIG. 22 is a view according to FIG. 21 with a swiveled yarn manipulator.

FIGS. 21 and 22 show an optional structural solution, in which the yarn manipulator 12, the yarn cutting unit 9, and the first suction unit 7 form a structural unit with the spinning nozzle 28, that is, with a housing encasing the vortex chamber 1 (wherein the yarn cutting unit 9, for instance a cutter, could also be positioned inside the first suction unit 7). In this case it can be provided that, similar to FIG. 17, the yarn forming element 15 is designed as an axially movable part. In addition, the second suction unit 10 described above, and/or a yarn end preparation device 11 (for instance within the second suction unit 10 or in another position) can be provided, wherein this is not absolutely necessary.

In order to be able to move the yarn 4 as close as possible, and in as stable a position as possible to the area of the exit opening 8, the yarn forming element 15 (as shown in FIG. 22) can comprise in the area of the exit opening 8 a recess extending parallel to the leaf level, into which the respective yarn section is inserted.

It is also possible in the case of FIGS. 1 to 11 to integrate the second unit 10 and/or the yarn end preparation device 11 into a service robot 27. In this case, the removal of the yarn fault 18 is carried out by the spinning station 2 itself, while the suction and/or preparation of the yarn end for the subsequent attachment step to the fibre strand 3 can be carried out with the aid of the service robot 27.

Figure 23:
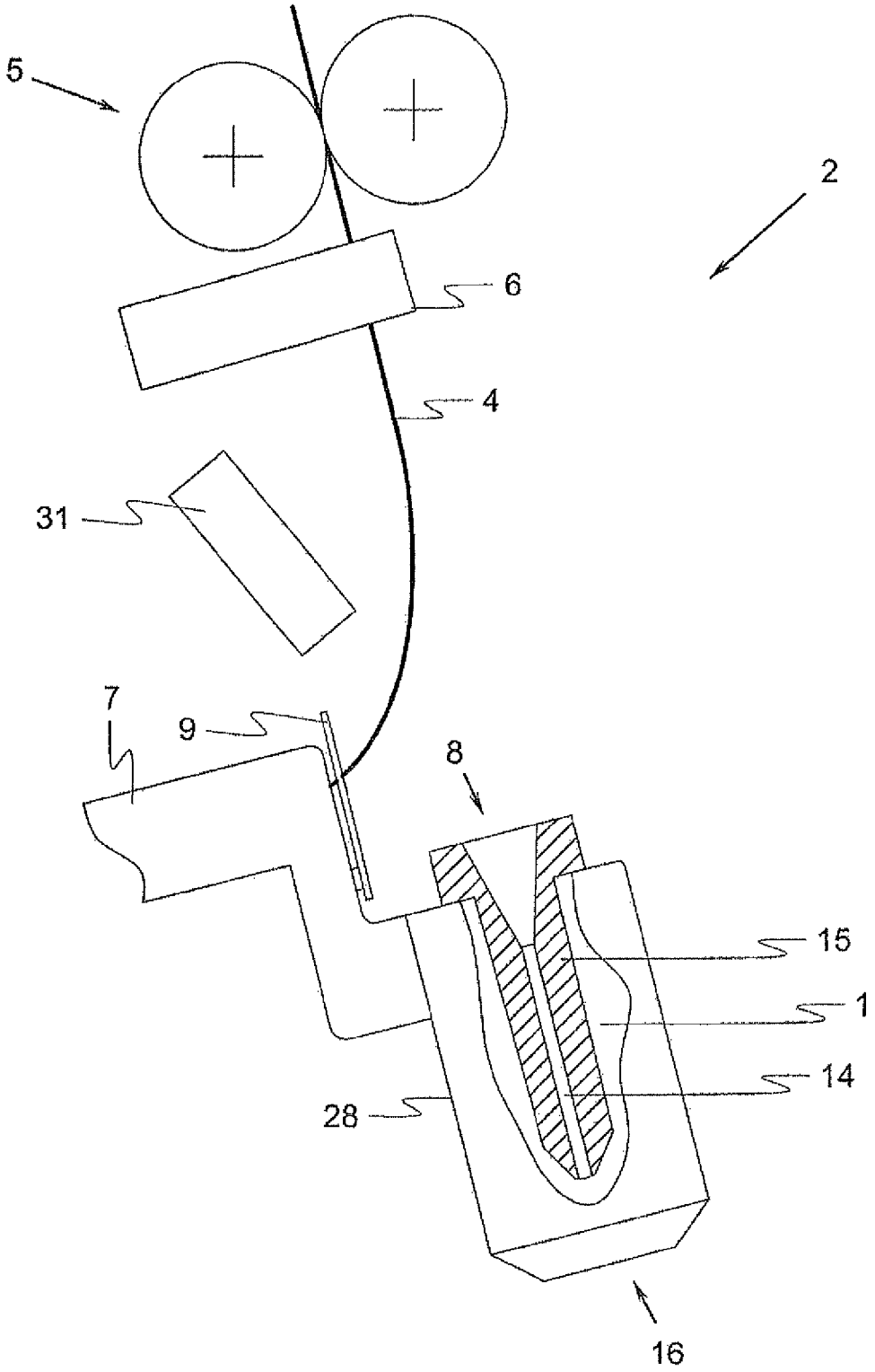
FIG. 23 is a schematic depiction of a section of the spinning station of a further air jet spinning machine according to the present invention.
Figure 24:
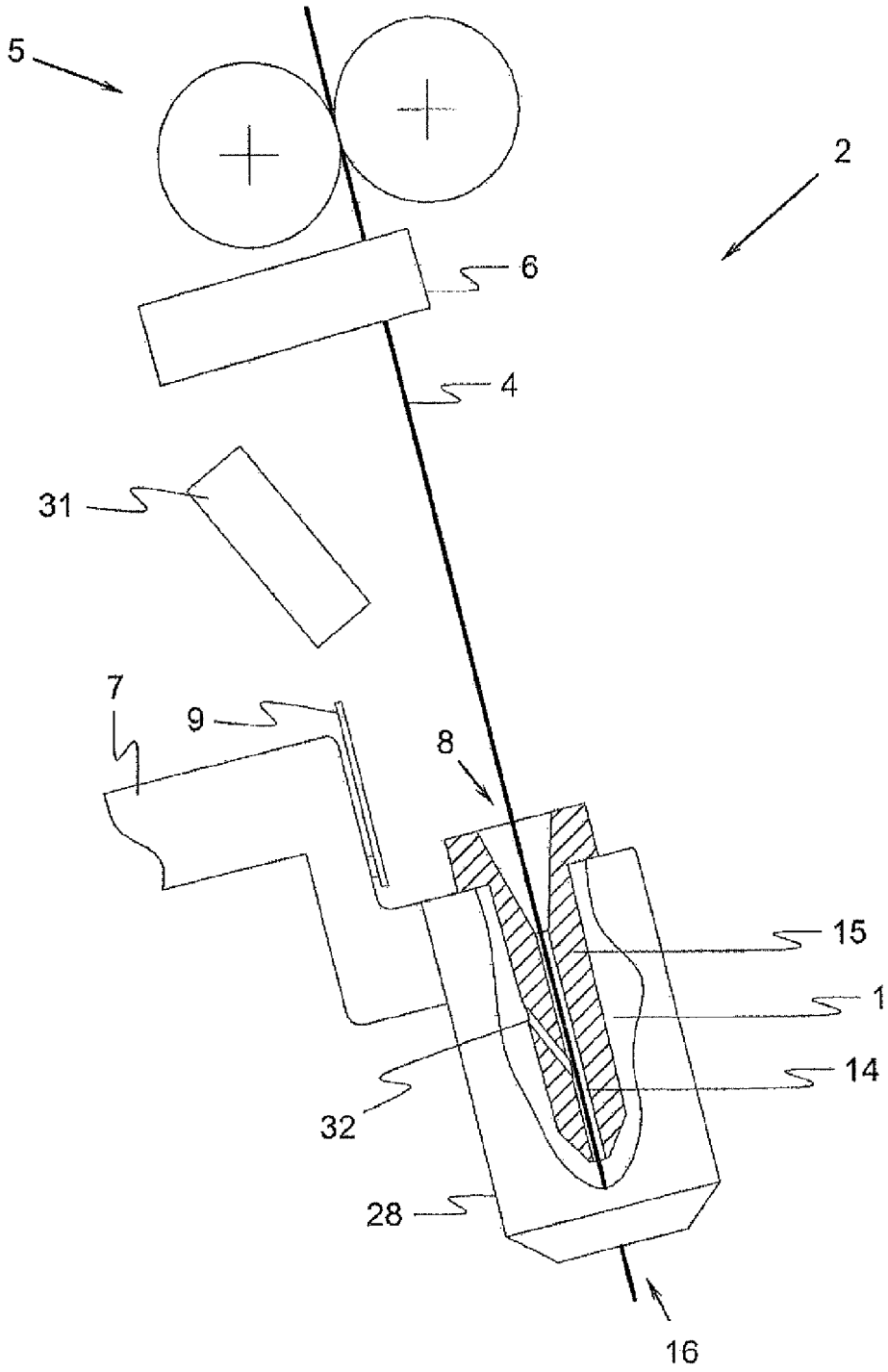
FIG. 24 is a view according to FIG. 23 subsequent to activation of the blower unit.

In conclusion, a solution is shown in FIGS. 23 and 24, in which a blower unit 31 having a connection to a compressed air source is applied instead of the above described, mechanically functioning yarn manipulator 12. This blower unit 31 can for instance be positioned (as shown) as a separate component in the area of the outlet opening 8 of the vortex chamber 1, or fixed to the first suction unit 7 or else integrated into the first suction unit 7 (e.g. in such a way that the air outlet opening of the blower unit 31 runs into the inner lying suction channel of the first suction unit 7).

In any case, the blower unit 31 should be aligned in such a way that the airflow generated by it can grip the yarn end remaining in or outside of the first suction unit 7 after the removal of the yarn fault 18, and selectively blow it into the area of the outlet opening 8 of the vortex chamber 1. There, it reaches the area of an air stream directed in the direction of the inlet opening 16 of the vortex chamber 1, which air stream pulls the yarn end into the withdrawal channel 14 by means of a suction action, suctions it through the withdrawal channel 14 and moves, or respectively, blows it into the area (disposed outside of the vortex chamber 1) upstream of the inlet opening 16.

The above mentioned air stream is generated on the basis of the Venturi effect and preferably with the aid of one or more air injection nozzle(s) 32 (shown only in FIG. 24 for reasons of clarity), which air injection nozzle(s) 32 is/are also in contact with a compressed air source (not shown). The air injection nozzle(s) 32 runs into the withdrawal channel 14 and generates an air stream there in the direction of the inlet opening 16 of the vortex chamber 1. As a result, the blower unit 31 and the air injection nozzle(s) 32 effect that the yarn 4 takes up a course as shown in FIG. 24.

At this stage the yarn end can be gripped by a second suction unit 10 assigned to the spinning station 2, and/or by a yarn end preparation device 11 assigned to the spinning station 2 or, alternatively to the above mentioned components, by service personnel or a service robot 27 and subjected to the piecing process.

The present invention is not limited to the shown and described embodiments. Variations within the scope of the patent claims are equally possible as a combination of the features, even when they are shown and described in various embodiments.

The invention claimed is:

1. A process for operating an air jet spinning machine having at least one spinning station with a vortex chamber, wherein a fiber strand is fed in a spinning direction to the vortex chamber and receives a twist in the vortex chamber such that a twisted yarn is formed from the fiber strand in a spinning process and is withdrawn from the vortex chamber by a withdrawal device, the process comprising:

monitoring the withdrawn yarn with a monitoring device downstream of the vortex chamber;

upon detection of a yarn fault, interrupting the spinning process in a manner such that the yarn detaches from the fiber strand and forms a yarn end;

subsequent to interruption of the spinning process, performing a piecing process with the yarn end by:

with a first suction unit configured as a component of the spinning station, suctioning the yarn end in an area between an outlet opening of the vortex chamber and the withdrawal device;

in the area of the first suction device, cutting a section of the yarn end containing the yarn fault with a cutting unit configured as a component of the spinning station;

returning the yarn end to the vortex chamber in a direction opposite to the spinning direction with an airstream generated within the vortex chamber or within a withdrawal channel of a yarn forming element that projects into the vortex chamber;

seizing the yarn end at an inlet opening of the vortex chamber and preparing the yarn end for attachment to an end section of the fiber strand;

superimposing the prepared yarn end with the end section of the fiber strand and jointly drawing the superimposed yarn end and fiber strand back into the vortex chamber with the withdrawal device; and resuming the spinning process by continued feed of the fiber strand and withdrawal of the formed yarn from the vortex chamber.

2. The process as in claim 1, wherein the yarn end is seized at the inlet opening of the vortex chamber by a second suction unit and guided into a yarn end preparation device for preparing the yarn end.

3. The process as in claim 1, wherein the spinning process is interrupted by reducing a transporting speed of a fiber strand delivery device and the withdrawal device in a coordinated manner such that the yarn detaches from the fiber strand within a withdrawal channel of a yarn forming element that projects into the vortex chamber, or between the outlet opening of the vortex chamber and the withdrawal device.

4. The process as in claim 1, wherein a section of the yarn end extending between the first suction unit and the withdrawal device subsequent to suction of the yarn end by the first suction unit is gripped by a yarn manipulator prior and moved towards the outlet opening of the vortex generator thereby forming a yarn loop between the first suction unit and the outlet opening prior to cutting the end section of the yarn containing the yarn fault.

5. The process as in claim 1, wherein the yarn end is returned to the vortex chamber by blowing the yarn end into the area of the outlet opening of the vortex chamber with an airstream generated by a blower unit that is a component of the first suction unit and with the airstream generated within the vortex chamber or within the withdrawal channel of the yarn forming element that projects into the vortex chamber.

6. The process as in claim 1, wherein the yarn end is seized at the inlet opening of the vortex chamber by a suction nozzle of a second suction unit that is moved from a standby position into a first piecing position at the inlet opening to the vortex chamber, the suction nozzle moving from the first piecing position to a second piecing position located upstream of a front roller pair of a fiber strand delivery device prior to superimposing the yarn end with the end section of the fiber strand.

7. The process as in claim 6, wherein a roller of the front roller pair is moved from a spinning position to a piecing position wherein the rollers of the first roller pair are spaced apart prior to movement of the suction nozzle from the standby position to the first piecing position, the roller moved from the piecing position back to the spinning position wherein the rollers of the front roller pair are in contact with each other prior to the yarn end and the end section of the fiber strand being superimposed.

8. The process as in claim 1, wherein the withdrawn yarn is wound onto a bobbin during the spinning process, wherein in the event of a yarn break and prior to performing the piecing process, the yarn end on the bobbin is gripped and moved to the area of the first suction device.

9. The process as in claim 1, wherein the withdrawn yarn is wound onto a bobbin during the spinning process and when a full bobbin level is detected, the interruption of the spinning process and the piecing process are performed, and subsequent to the piecing process, the following are performed:

the yarn exiting the vortex chamber is cut;

subsequent to the cutting, a section of the yarn is produced and stored in an intermediate storage;

the full bobbin is replaced with an empty bobbin;

the stored yarn is withdrawn from the intermediate storage and wound onto the empty bobbin; and wherein the steps of cutting the yarn exiting the vortex chamber, storage of the yarn in an intermediate storage, replacement of the full bobbin with an empty bobbin, and winding of the stored yarn on the empty bobbin are all performed by a service robot brought to the spinning station.

10. The process as in claim 1, wherein the withdrawn yarn is wound onto a bobbin during the spinning process and when a full bobbin level is detected, the interruption of the spinning process is performed, a yarn end of a separate piecing yarn is suctioned by the first suction unit and used in the subsequent piecing process, wherein subsequent to the piecing process the following are performed:

the yarn exiting the vortex chamber is cut;

a section of the yarn is produced and stored in an intermediate storage;

the full bobbin is replaced with an empty bobbin;

the stored yarn is withdrawn from the intermediate storage and wound onto the empty bobbin; and wherein the steps of cutting the yarn exiting the vortex chamber, storage of the yarn in an intermediate storage, replacement of the full bobbin with an empty bobbin, and winding of the stored yarn on the empty bobbin are all performed by a service robot brought to the spinning station.

11. An air jet spinning machine, comprising:

at least one spinning station having a vortex chamber with an inlet opening and an outlet opening, wherein a fiber strand is fed in a spinning direction into the inlet opening and receives a twist in the vortex chamber such that a twisted yarn is formed from the fiber strand in a spinning process and is withdrawn from the outlet opening of the vortex chamber;

a delivery device disposed to deliver the fiber strand to the inlet opening;

a withdrawal device disposed to withdraw the yarn from the vortex chamber;

a yarn monitor disposed downstream of the vortex chamber to detect faults in the withdrawn yarn;

a first suction unit disposed so as to suction a yarn end between the outlet opening of the vortex generator and the withdrawal device;

a yarn cutting unit disposed so as to cut the suctioned yarn end between the outlet opening and the withdrawal device; and an air injection nozzle disposed so as to introduce air in the direction of the inlet opening into the vortex chamber or within a withdrawal channel of a yarn forming element that projects into the vortex chamber.

12. The air jet spinning machine as in claim 11, further comprising a yarn end preparation device disposed in an area of the inlet opening to prepare a yarn end for subsequent piecing with the fiber strand, and a second suction unit disposed in the area of the inlet opening to guide the yarn end into the preparation device.

13. The air jet spinning machine as in claim 12, further comprising a pivotable movable yarn manipulator disposed so as to contact and move a yarn section extending between the first suction unit and the withdrawal device towards the outlet opening of the vortex chamber.

14. The air jet spinning machine as in claim 13, wherein the first suction unit further comprises a blower unit disposed so as to blow the yarn end with an airstream into the area of the outlet opening of the vortex chamber, wherein the first suction unit, the yarn cutting unit, and the yarn manipulator are all fixed to a housing that encases the vortex chamber.

15. The air jet spinning machine as in claim 14, further comprising a yarn forming element that projects into the vortex chamber, the yarn forming element defining a yarn withdrawal channel and the outlet opening, the yarn forming element movable relative to the inlet opening.

16. The air jet spinning machine as in claim 12, wherein the delivery device comprises a front roller pair upstream of inlet opening, the second suction unit further comprising a movably mounted suction nozzle that is movable between a standby position into a first piecing position at the inlet opening to the vortex chamber, the suction nozzle movable from the first piecing position to a second piecing position located upstream of the front roller pair of the delivery device.

17. The air jet spinning machine as in claim 12, wherein the spinning machine comprises at least two of the spinning stations, each of the spinning stations having a respective second suction unit, the yarn end preparation device being common to the two spinning stations such that the vortex chamber of each respective spinning station can be brought into connection with the common yarn end preparation device via their respective second suction unit, and wherein the delivery device comprises a front roller pair upstream of inlet opening, wherein at least one roller of the front roller pair is movable from a spinning position wherein the rollers of the front roller pair are in contact into a piecing position wherein the rollers are spaced apart.

18. The air jet spinning machine as in claim 11, wherein the spinning station comprises a spinning nozzle, the vortex chamber defined in the spinning nozzle, the spinning nozzle being movable from a spinning position into a piecing position, and further comprising a yarn storage device disposed downstream of the withdrawal device.

* * * * *